US011404812B2

(12) United States Patent
Hung

(10) Patent No.: US 11,404,812 B2
(45) Date of Patent: Aug. 2, 2022

(54) CONNECTOR

(71) Applicant: DONGGUAN XUNTAO ELECTRONIC CO., LTD., Dongguan (CN)

(72) Inventor: Yung-Chih Hung, Dongguan (CN)

(73) Assignee: DONGGUAN XUNTAO ELECTRONIC CO., LTD., Guangdong (CN)

( * ) Notice: Subject to any disclaimer, the term of this patent is extended or adjusted under 35 U.S.C. 154(b) by 5 days.

(21) Appl. No.: 17/100,659

(22) Filed: Nov. 20, 2020

(65) Prior Publication Data

US 2021/0075145 A1 Mar. 11, 2021

Related U.S. Application Data

(60) Provisional application No. 62/949,484, filed on Dec. 18, 2019.

(30) Foreign Application Priority Data

Jun. 12, 2020 (TW) ..... 109119976

(51) Int. Cl.
*H01R 13/04* (2006.01)
*H01R 13/115* (2006.01)
(Continued)

(52) U.S. Cl.
CPC ..... *H01R 13/04* (2013.01); *H01R 13/11* (2013.01); *H01R 13/114* (2013.01);
(Continued)

(58) Field of Classification Search
CPC ..... H01R 13/04; H01R 13/11; H01R 13/114; H01R 13/115; H01R 13/405;
(Continued)

(56) References Cited

U.S. PATENT DOCUMENTS 5,211,706 A 5/1993 Polgar
6,666,708 B2 12/2003 Saito
(Continued)

FOREIGN PATENT DOCUMENTS

CN 2374993 Y 4/2000
CN 2821907 Y 9/2006
(Continued)

*Primary Examiner* — Truc T Nguyen
(74) *Attorney, Agent, or Firm* — Birch, Stewart, Kolasch & Birch, LLP

(57) ABSTRACT

A connector includes a female terminal, an insulative housing, and a cover component. The female terminal includes a mating segment, a holding segment, and a bent segment. The mating segment has a mating axial direction, the holding segment has an accommodation channel, and a wire is disposed in the accommodation channel. The accommodation channel has an accommodation-channel axial direction. The bent segment is connected to the mating segment and the holding segment. The insulative housing includes a mating accommodation channel and a holding accommodation channel, which communicate with each other. The mating segment of the female terminal is disposed in the mating accommodation channel, and the holding segment and the wire are disposed in the holding accommodation channel. The cover component is covered on the insulative housing, and has a buckling convex portion. The buckling convex portion abuts against a buckling shoulder on the insulative housing.

17 Claims, 28 Drawing Sheets

(51) Int. Cl.

| | |
|---|---|
| ***H01R 13/11*** | (2006.01) |
| ***H01R 13/405*** | (2006.01) |
| ***H01R 13/508*** | (2006.01) |
| *H01R 4/18* | (2006.01) |
| *H01R 13/512* | (2006.01) |

(52) U.S. Cl.
CPC ..... *H01R 13/115* (2013.01); *H01R 13/405* (2013.01); *H01R 13/508* (2013.01); *H01R 4/184* (2013.01); *H01R 13/512* (2013.01)

(58) Field of Classification Search
CPC .... H01R 13/508; H01R 4/184; H01R 13/512; H01R 43/16; H01R 13/055; H01R 13/113; H01R 13/582; H01R 13/05; H01R 13/46
See application file for complete search history.

(56) References Cited

U.S. PATENT DOCUMENTS

| | | | | |
|---|---|---|---|---|
| 9,660,379 | B1 | 5/2017 | Burkman | |
| 11,220,229 | B2 * | 1/2022 | Lunde | B60R 16/03 |
| 2001/0023143 | A1 * | 9/2001 | Middlehurst | H01R 12/716 439/79 |
| 2002/0115335 | A1 | 8/2002 | Saito | |
| 2002/0137397 | A1 * | 9/2002 | Little | H01R 13/7032 439/686 |
| 2006/0086900 | A1 * | 4/2006 | Nakamura | H01R 13/6633 250/239 |
| 2018/0337480 | A1 | 11/2018 | Hanyu | |
| 2021/0075145 | A1 * | 3/2021 | Hung | H01R 13/114 |
| 2022/0010603 | A1 * | 1/2022 | Karrasch | E05C 3/12 |

FOREIGN PATENT DOCUMENTS

| | | | |
|---|---|---|---|
| CN | 1856912 | A | 11/2006 |
| CN | 200941182 | Y | 8/2007 |
| CN | 201075465 | Y | 6/2008 |
| CN | 201359788 | Y | 12/2009 |
| CN | 104094479 | A | 10/2014 |
| CN | 104425953 | A | 3/2015 |
| CN | 205194897 | U | 4/2016 |
| CN | 103748745 | B | 8/2016 |
| CN | 106256049 | A | 12/2016 |
| CN | 106716728 | A | 5/2017 |
| CN | 207398398 | U | 5/2018 |
| CN | 109119785 | A | 1/2019 |
| CN | 109167207 | A | 1/2019 |
| CN | 208368769 | U | 1/2019 |
| CN | 208385684 | U | 1/2019 |
| CN | 208782088 | U | 4/2019 |
| CN | 110176679 | A | 8/2019 |
| CN | 209448057 | U | 9/2019 |
| CN | 110518385 | A | 11/2019 |
| DE | 4312641 | A1 | 10/1994 |
| JP | 2010-27372 | A | 2/2010 |
| TW | 201539874 | A | 10/2015 |
| TW | I539684 | B | 6/2016 |
| TW | I575815 | B | 3/2017 |
| TW | 201916504 | A | 4/2019 |
| TW | M4580815 | U | 7/2019 |
| TW | I668922 | B | 8/2019 |

* cited by examiner

CONNECTOR

CROSS-REFERENCES TO RELATED APPLICATIONS

This application claims the benefit of U.S. provisional application Ser. No. 62/949,484, filed on Dec. 18, 2019 and claims the priority of Patent Application No. 109119976 filed in Taiwan, R.O.C. on Jun. 12, 2020. The entirety of the above-mentioned patent applications are hereby incorporated by references herein and made a part of the specification.

BACKGROUND

Technical Field

The present disclosure relates to an electrical connector.

Related Art

Generally, an electrical connector (or a connector) includes an electrical terminal, such as a socket terminal. Engaging a pin terminal with a socket terminal can connect a plurality of circuits or wires to transmit electric power or electronic signals. The pin terminal and the socket terminal are generally also referred to as a male terminal and a female terminal. In order to meet more diverse wiring requirements or circuit arrangements, novel electrical connectors are still required.

SUMMARY

The present disclosure provides a connector with a bent female terminal. According to the connector, an angle exists between an axial direction of a male terminal to be subsequently inserted and an axial direction of a wire in contact with the female terminal, so that more types of wiring requirements and designs can be met. In addition, line expansion may also be performed on the connector, so that the connector has greater wiring freedom.

The connector includes a female terminal, an insulative housing, and a cover component. The female terminal includes a mating segment, a holding segment, and a bent segment. The mating segment has a mating axial direction. The holding segment has an accommodation channel, and a wire is disposed in the accommodation channel. The accommodation channel has an accommodation-channel axial direction. The bent segment is connected to the mating segment and the holding segment, and the mating axial direction is substantially not parallel to the accommodation-channel axial direction. The insulative housing includes a mating accommodation channel and a holding accommodation channel. The mating accommodation channel is in communication with the holding accommodation channel. The mating segment of the female terminal is disposed in the mating accommodation channel, and the holding segment and the wire are disposed in the holding accommodation channel. The cover component is covered on the insulative housing, and has a buckling convex portion. The buckling convex portion abuts against a buckling shoulder on the insulative housing.

According to some embodiments of the present disclosure, the connector includes: a plurality of mating accommodation channels arranged into a first mating accommodation channel row, the mating accommodation channel in the first mating accommodation channel row being a first mating accommodation channel; a plurality of holding accommodation channels, a number of the plurality of holding accommodation channels corresponding to a number of the mating accommodation channels in the first mating accommodation channels row; and a second mating accommodation channel row consisting of a plurality of second mating accommodation channels, disposed side by side with the first mating accommodation channel row, and being farther from the holding accommodation channel than the first mating accommodation channel row. A holding accommodation channel isolation wall exists between the plurality of holding accommodation channels, and the cover component having a supporting plate protruding toward the mating segment, the supporting plate abutting against the holding accommodation channel isolation wall.

According to some embodiments of the present disclosure, a female terminal disposed in the first mating accommodation channel row is a first female terminal, a wire connected to the first female terminal being a first wire; and the connector further includes an isolation plate disposed above the first wire and located between the cover component and the insulative housing, where the holding accommodation channel isolation wall has a groove, the isolation plate being disposed in the groove.

According to some embodiments of the present disclosure, the isolation plate has at least one embedding slit, at least one holding accommodation channel isolation wall being embedded in the embedding slit.

According to some embodiments of the present disclosure, an isolation sheet exists above the isolation plate, the isolation sheet being disposed corresponding to the holding accommodation channel isolation wall.

According to some embodiments of the present disclosure, a mating accommodation channel row isolation wall exists between the first mating accommodation channel row and the second mating accommodation channel row.

According to some embodiments of the present disclosure, a pressing sheet protrudes from the isolation plate toward the bent segment, the pressing sheet being disposed at a position at which the first mating accommodation channel is in communication with the holding accommodation channel; and a tail end of the isolation plate has an end wall extending toward the mating segment, a holding space being formed between the end wall and the pressing sheet, the holding space accommodating the mating accommodation channel row isolation wall.

According to some embodiments of the present disclosure, a shape of one side of the pressing sheet matches a bending shape of a bent segment of the first female terminal.

According to some embodiments of the present disclosure, the connector further includes another female terminal disposed in the second mating accommodation channel row and being a second female terminal, a wire connected to the second female terminal being a second wire, and the second female terminal and the second wire being disposed above the isolation plate.

According to some embodiments of the present disclosure, an accommodation-channel axial direction of the first female terminal is parallel to an accommodation-channel axial direction of the second female terminal.

According to some embodiments of the present disclosure, the cover component further includes a cover component pressing sheet protruding downward and disposed corresponding to the second female terminal, a shape of one side of the cover component pressing sheet matching a bending shape of a bent segment of the second female terminal.

According to some embodiments of the present disclosure, a length of a bent segment of the second female terminal is greater than a length of a bent segment of the first female terminal.

According to some embodiments of the present disclosure, the cover component has a bolt hole, the holding accommodation channel isolation wall having a bolt slot corresponding to the bolt hole of the cover component; and the connector further includes a fixing bolt inserted from the bolt hole of the cover component into the bolt slot. The fixing bolt has an opening, and one end of the fixing bolt close to the insulative housing has a barb, and the bolt slot has a bolt slot neck, the barb abutting against a lower part of the bolt slot neck.

According to some embodiments of the present disclosure, a shallow groove is formed at an opening part above the bolt hole of the cover component, and a blocking component exists at an upper part of the fixing bolt, the blocking component being accommodated in the shallow groove.

According to some embodiments of the present disclosure, a fixing bolt assistance component is further disposed above the fixing bolt, the fixing bolt assistance component being configured to be removable from the fixing bolt.

According to some embodiments of the present disclosure, an inner wall of the mating accommodation channel has a blocker, a part of the mating segment abutting against the blocker to prevent the mating segment from moving forward, and the inner wall of the mating accommodation channel further has a backstop groove, and the mating segment has a backstop arm protruding toward outside of a passage, the backstop arm abutting against the backstop groove to prevent the mating segment from moving backward.

DETAILED DESCRIPTION

Figure 1:
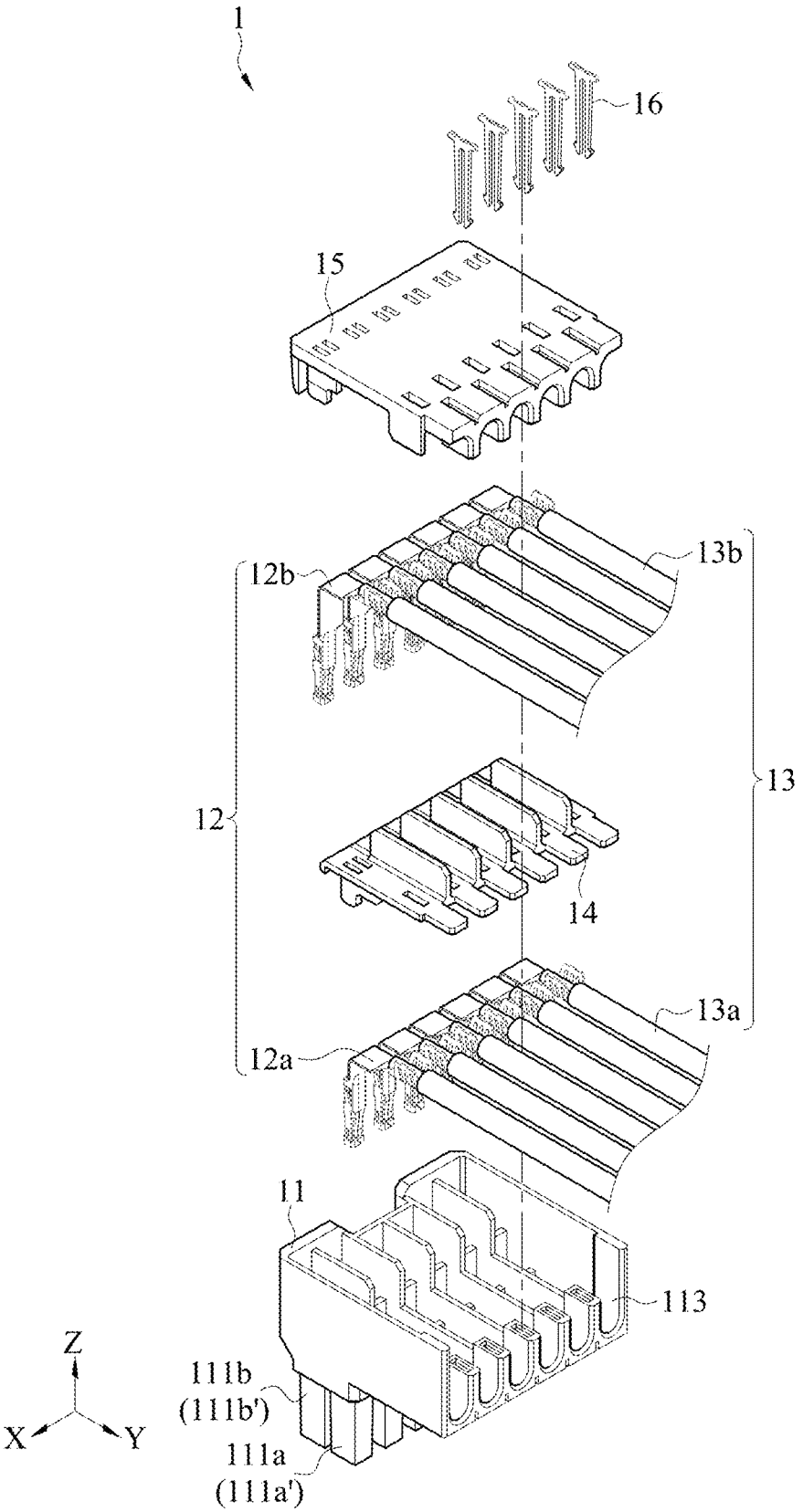
FIG. 1 is a schematic exploded view of a connector according to some embodiments of the present disclosure.

The following describes the connector and the female terminal in the embodiments of the present disclosure in detail. It should be known that the following descriptions provide many different embodiments to implement different aspects of the present disclosure. The following specific elements and arrangement manners are merely used for briefly and clearly describing some embodiments of the present disclosure, and are not intended to limit the present disclosure. In addition, similar and/or corresponding marks may be used in different embodiments to indicate similar and/or corresponding elements, to clearly describe the present disclosure. However, these similar and/or corresponding marks are merely used for briefly and clearly describing some embodiments of the present disclosure, and do not represent any correlation between different embodiments and/or structures discussed herein.

It should be understood that, the element or apparatus in the drawing may exist in any form that is familiar to a person skilled in the art. In addition, relative terms may be used in the embodiments, such as "lower", "bottom", "higher", or "top", to describe a relative relationship of one element to another element in the figure. It can be understood that if the apparatus in the drawing is turned upside down, the element described on the "lower" side may be an element on the "higher" side. The drawings of the present disclosure are not drawn to scale, and in fact, a size of the element may be arbitrarily enlarged or reduced to clearly present features of the present disclosure.

Figure 2:
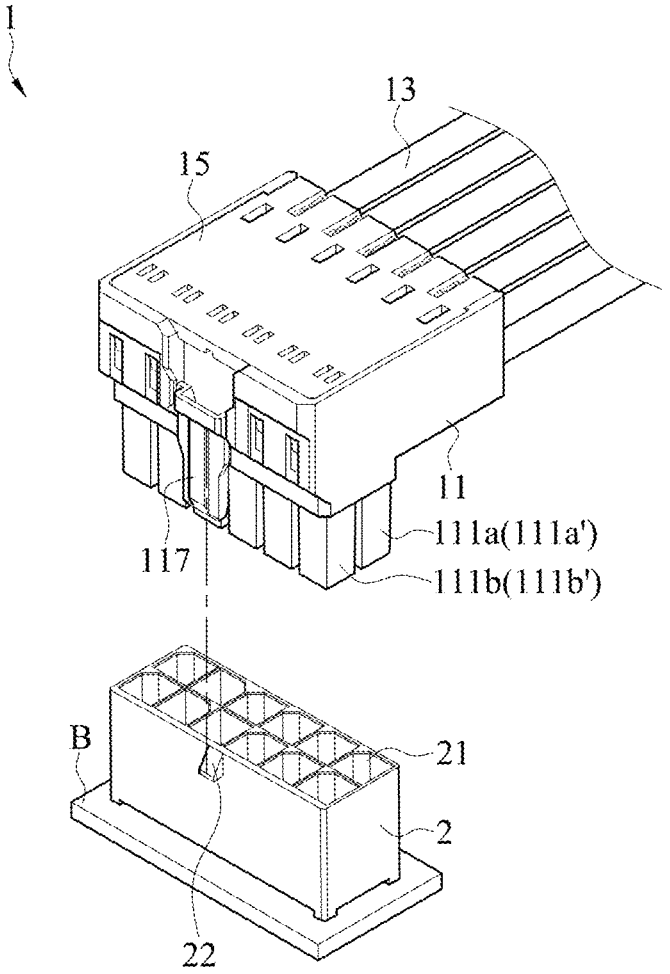
FIG. 2 is a schematic diagram of a usage state of the connector according to some embodiments of the present disclosure.

Referring to FIG. 1 and FIG. 2 first, FIG. 1 is a schematic exploded view of a connector 1 using a female terminal provided in the present disclosure according to some embodiments, and FIG. 2 is a schematic diagram of a usage state of the connector 1 according to some embodiments. The connector 1 and a socket 2 are disconnected. It should be noted that application of the female terminal is merely briefly described herein, and specific elements of the connector 1 are described in detail below.

Figure 11A:
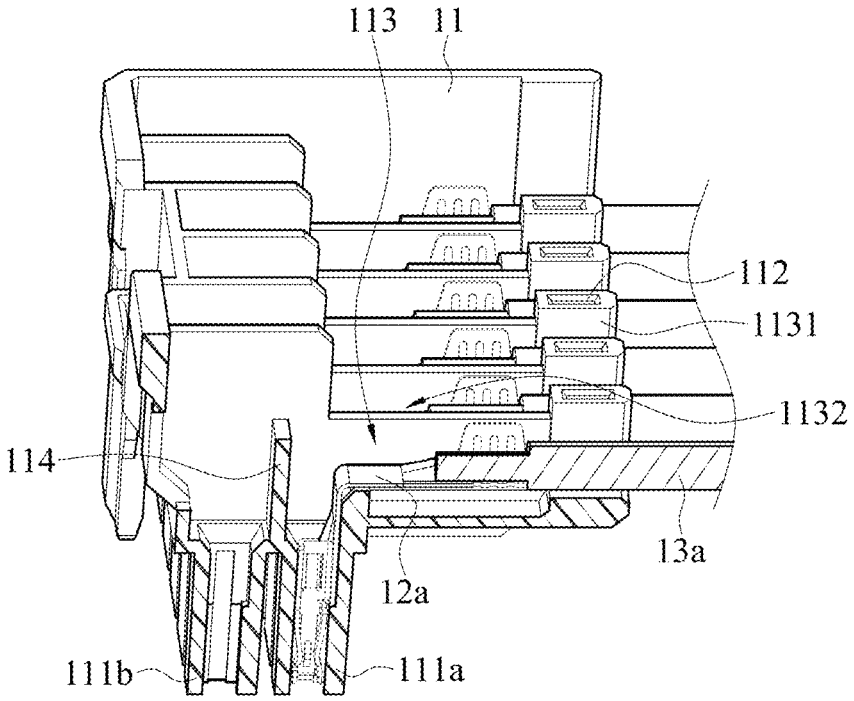
FIG. 11A, FIG. 11B, FIG. 12A, FIG. 12B, FIG. 13A, FIG. 13B, FIG. 14A, FIG. 14B, FIG. 15A, FIG. 15B, FIG. 16A, and FIG. 16B show cross-sections of a connector according to some embodiments along the first first wire in various manufacturing steps and are top views of corresponding connectors.

As shown in FIG. 1, in some embodiments, the connector 1 includes an insulative housing 11, a female terminal 12 (for example, a first female terminal 12*a* in FIG. 1), a wire 13 (for example, a first wire 13*a* in FIG. 1) electrically connected to the female terminal 12, and a cover component 15. The insulative housing 11 has mating accommodation channels 111*a* and 111*b* extending substantially along a longitudinal direction in the figure (for example, a Z-axis direction in FIG. 1) and a holding accommodation channel 113 extending substantially along a horizontal direction in the figure (for example, a Y-axis in FIG. 1). In the embodiment shown in FIG. 1, the plurality of mating accommodation channels may be arranged into a first mating accommodation channel row 111*a'* along a direction X in FIG. 1. The mating accommodation channel in the first mating accommodation channel row 111*a'* is a first mating accommodation channel 111*a*. The first mating accommodation channel 111*a* is in communication with the holding accommodation channel 113 (see FIG. 11A below, FIG. 11A shows a cross-section of the connector 1 along the first wire 13*a* in a specific manufacturing step according to some embodiments).

In some embodiments, as shown in FIG. 1 (or referring to FIG. 11A below), the first wire 13*a* is disposed in the holding accommodation channel 113, one end of the first female terminal 12*a* is electrically connected to one end of the first wire 13*a*, and the other end of the first female terminal 12*a* is disposed in the first mating accommodation channel 111*a*. In the embodiment shown in FIG. 1, since an angle between an extending direction of the first mating accommodation channel 111*a* and an extending direction of the holding accommodation channel 113 is approximately 90 degrees, an angle between an axis of a male terminal to be subsequently inserted into the first female terminal 12*a* and an axis of the first wire 13*a* is also approximately 90 degrees. However, it should be noted that the embodiment in FIG. 1 is merely an example, the angle between the mating accommodation channels 111*a* and 111*b* and the holding accommodation channel 113 is not limited thereto, and the angle between the axis of the male terminal of the first female terminal 12*a* and the axis of the first wire 13*a* is also not limited thereto.

Next, referring to FIG. 2, FIG. 2 is a schematic diagram of a usage state of the connector 1 according to some embodiments. In some embodiments, the socket 2 disposed on a printed circuit board B (or other suitable substrates) has a plurality of slots 21. The slots 21 may be disposed corresponding to the mating accommodation channels 111*a* and 111*b* of the connector 1, that is, one mating accommodation channel may be inserted into one slot 21 in the socket 2. The slot 21 in the socket 2 has a male terminal (or a male terminal pin) (not shown in FIG. 2, but reference may be made to a schematic diagram FIG. 20 of engagement between the socket 2 and the insulative housing 11). During mating between the connector 1 and the socket 2, a buckling portion 117 of the insulative housing 11 may be engaged with a locking convex portion 22 on the socket 2. At this time, the male terminal pin is at least partially inserted into the female terminal 12 so that an electrical connection is formed. According to the connector 1, an outgoing direction of the wire 13 may be adjusted to more effectively use space to meet more types of wiring requirements.

Figure 3A:
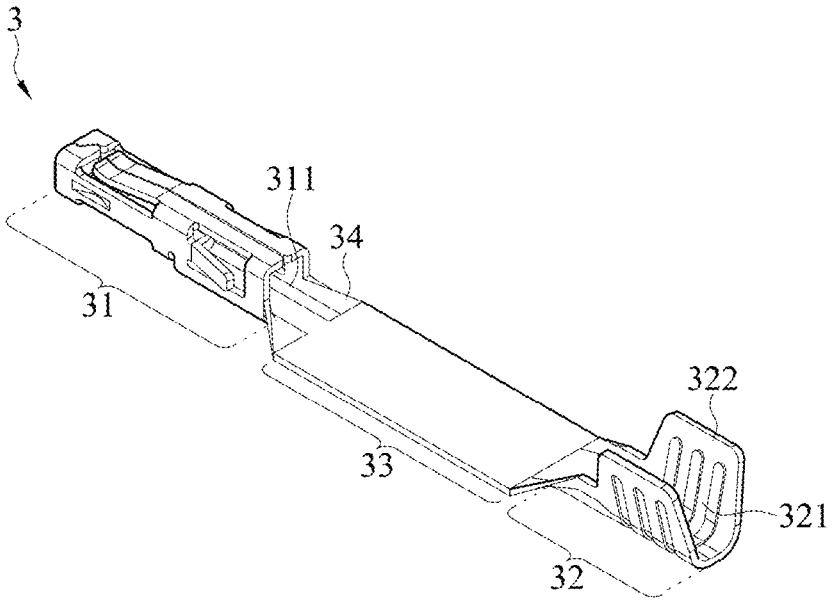
FIG. 3A is a three-dimensional schematic diagram of a female terminal according to some embodiments of the present disclosure.
Figure 3B:
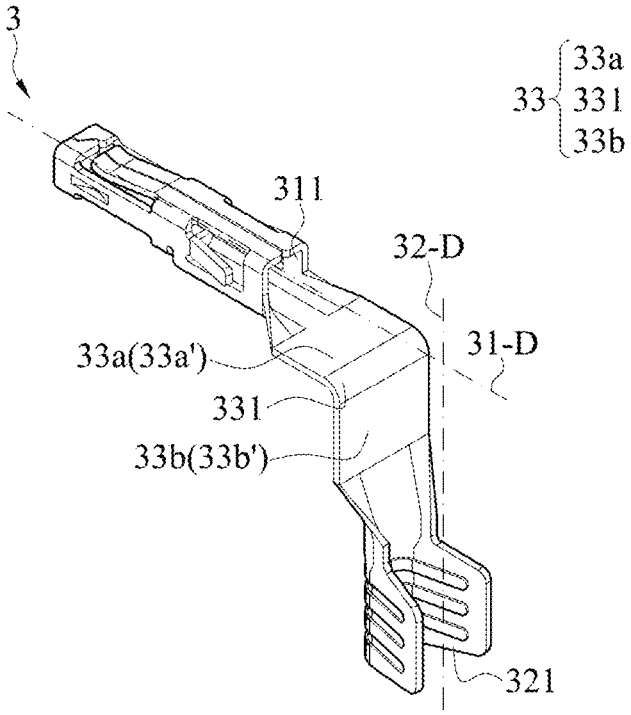
FIG. 3B is a three-dimensional schematic diagram of a female terminal (bent) according to some embodiments of the present disclosure.
Figure 3C:
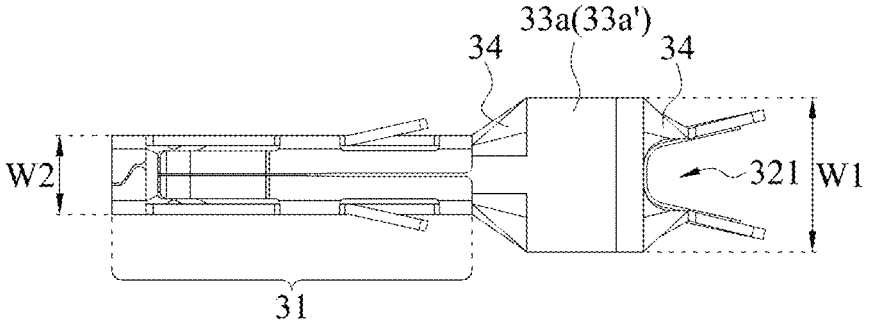
FIG. 3C is a schematic top view of a female terminal according to some embodiments of the present disclosure.
Figure 3D:
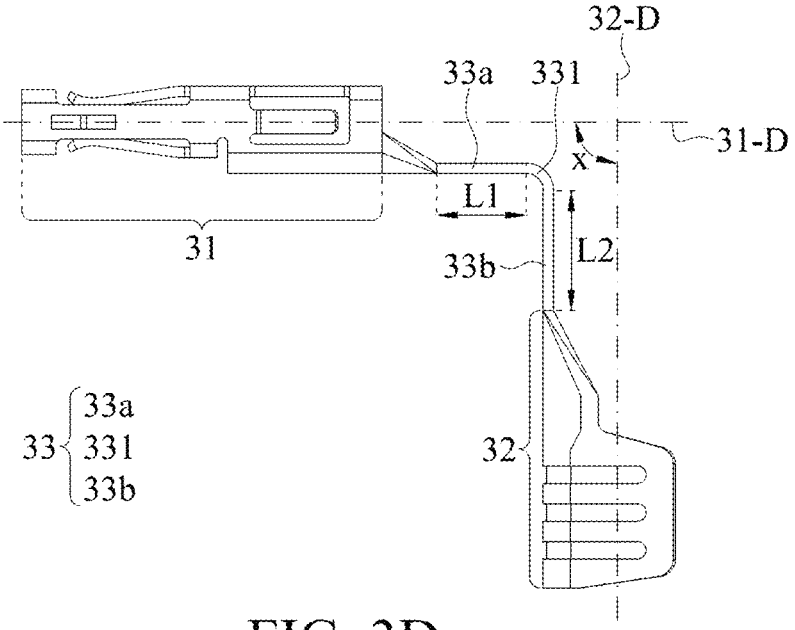
FIG. 3D is a schematic side view of a female terminal according to some embodiments of the present disclosure.

The present disclosure provides a female terminal 3 that can service as the above female terminal 12. Refer to FIG. 3A, FIG. 3B, FIG. 3C, and FIG. 3D. FIG. 3A is a three-dimensional schematic diagram of the female terminal 3 according to some embodiments. In order to more clearly illustrate each part, a bent segment 33 of the female terminal 3 is shown in an unbent shape. FIG. 3B is a three-dimensional schematic diagram of the female terminal 3 (a bent female terminal) according to some embodiments. FIG. 3C is a schematic top view of the female terminal 3 according to some embodiments. FIG. 3D is a schematic side view of the female terminal 3 according to some embodiments.

Still referring to FIG. 3A and FIG. 3B, according to some embodiments, the female terminal 3 includes a mating segment 31, a circuit connecting segment 32, and a bent segment 33 connecting the mating segment 31 and the circuit connecting segment 32. The mating segment 31 has a passage 311 that may be configured to accommodate at least a part of the male terminal and form contact with the male terminal. In some embodiments, the circuit connecting segment 32 may be a holding segment. The holding segment has an accommodation channel 321 that may be configured to accommodate the wire 13. However, it may be understood that although the circuit connecting segment 32 in the figure of the embodiment provided in the present disclosure is in a form of a holding segment, the circuit connecting segment 32 is not limited to the holding segment, and the circuit connecting segment 32 may also be replaced with a circuit connecting segment 32 in other forms in addition to the holding form, as long as the circuit connecting segment can be connected to a wire or a cable. For example, in some embodiments, the circuit connecting segment 32 may also be in a shape of an elongated male terminal to be connected to another female terminal.

In some embodiments, as shown in FIG. 3B, the passage 311 of the mating segment 31 has an extending direction that may be considered as an axial direction 31-D (or may be referred to as a passage axial direction or a mating axial direction) of the passage 311. In some embodiments, during subsequent insertion of the male terminal into the mating segment 31 of the female terminal 3, a direction in which the male terminal is inserted may also be considered as the mating axial direction 31-D of the mating segment 31, and the circuit connecting segment 32 has a holding axial direction 32-D. When the circuit connecting segment 32 is a holding segment, the extending direction of the accommodation channel 321 (that is, an axial direction of the accommodation channel or an accommodation-channel axial direction) of the holding segment may be considered as a holding axial direction 32-D of the circuit connecting segment 32. When the circuit connecting segment 32 is a not a holding segment, if a wire is to be disposed in the circuit connecting segment 32 subsequently, an extending direction of the wire in the circuit connecting segment 32 may be considered as the holding axial direction 32-D of the circuit connecting segment 32. When the circuit connecting segment 32 is elongated, an extending direction of the circuit connecting segment 32 may be considered as the holding axial direction 32-D of the circuit connecting segment 32. For brevity of description, the circuit connecting segment 32 is a holding segment 32, for example.

Figure 3E:
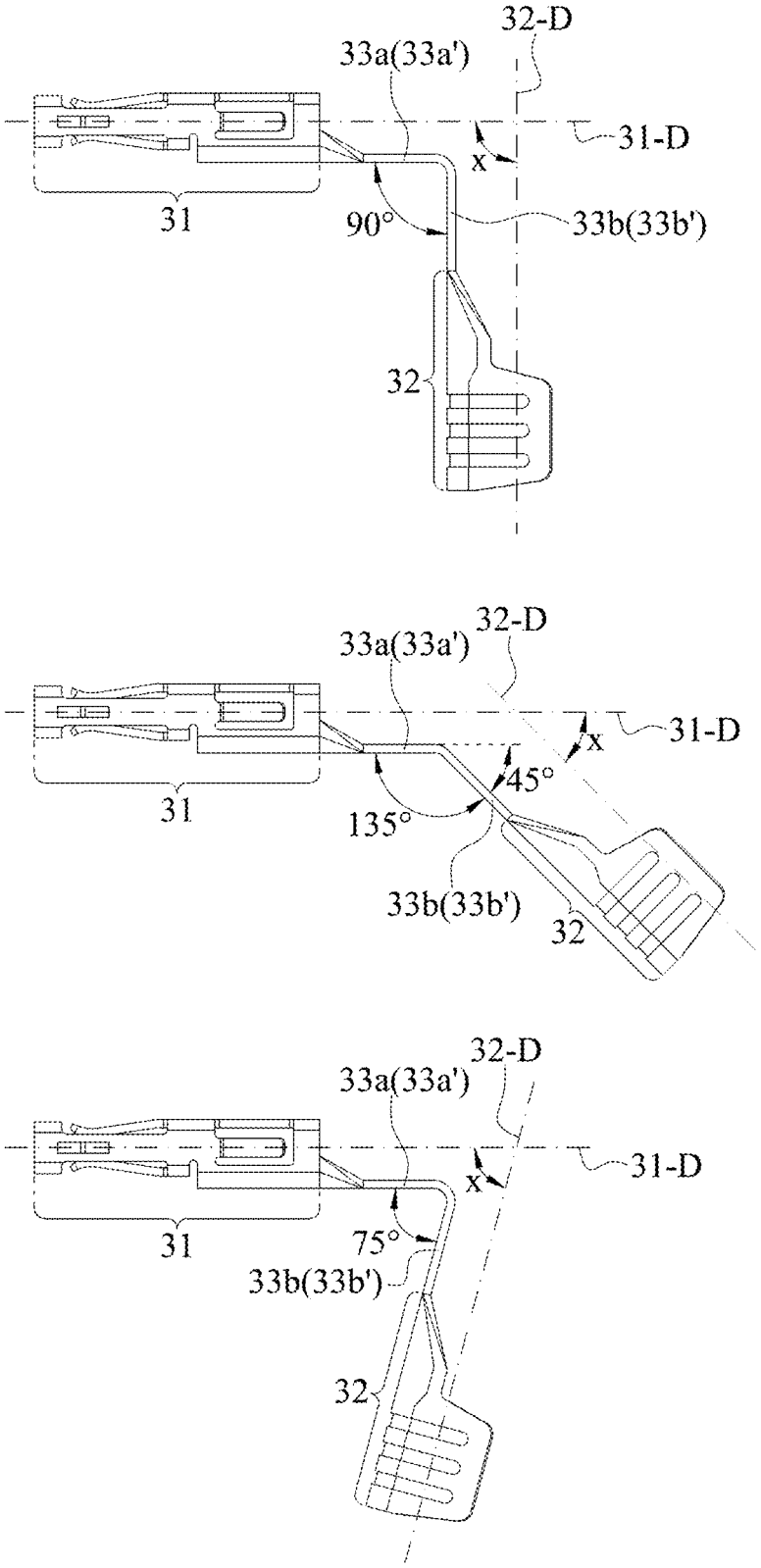
FIG. 3E is a schematic side view of a female terminal according to some embodiments of the present disclosure.

In some embodiments, the mating axial direction 31-D is substantially not parallel to the holding axial direction 32-D. In some embodiments, as shown in FIG. 3B and FIG. 3D, since the female terminal 3 has the bent segment 33, the axial direction 31-D of the passage 311 is substantially not parallel to the axial direction 32-D of the accommodation channel 321. In some embodiments, the above "not parallel" means that such a projection plane (for example, a projection plane of FIG. 3D may be a paper surface) can be found that an angle exists between a projection of the axial direction 31-D of the passage 311 on the projection plane and a projection of the axial direction 32-D of the accommodation channel 321 on the projection plane. For brevity of the following context, "an angle X exists between a projection on the projection plane in a direction A and a projection on the projection plane in a direction B" is briefly described as "an angle X exists between A and B" or similar terms. In some embodiments, "substantially not parallel" means that a smaller angle between the two is more than 15 degrees. In some embodiments, referring to FIG. 3E, an angle X between the axial direction 31-D of the passage 311 and the axial direction 32-D of the accommodation channel 321 may be 15 degrees to 90 degrees, for example, approximately 45 degrees to 90 degrees, for example 45, 55, 60, 75, or 90 degrees.

In some embodiments, the female terminal 3 is formed through stamping of a metal sheet. A sheet-like female terminal 3 having the mating segment 31 and the holding segment 32 but whose bent segment 33 still has a flat (unbent) area shown in FIG. 3A is first formed. Then the flat sheet-like material is bent to generate a bent portion 331 to form a bent segment 33, so as to obtain the female terminal 3 shown in FIG. 3B.

Still referring to FIG. 3B and FIG. 3D, in some embodiments, the bent portion 331 of the bent segment 33 may have a first plane portion 33*a* and a second plane portion 33*b* on two sides. In other words, a first plane portion 33*a* exists between the bent portion 331 and the mating segment 31, and a second plane portion 33*b* exists between the bent portion 331 and the holding segment 32. The first plane portion 33*a* has a first plane 33*a*', and the second plane portion 33*b* has a second plane 33*b*'. The mating axial direction 31-D (or the passage axial direction) is substantially parallel to the first plane 33*a*', and the holding axial direction 32-D (or the accommodation-channel axial direction) is substantially parallel to the second plane 33*b*'. An angle X exists between the first plane 33*a'* and the second plane 33*b*'. In some embodiments, for example, referring to FIG. 3E, the angle may be 15 degrees to 90 degrees, for example, approximately 45 degrees to 90 degrees, for example, 45, 55, 60, 75, or 90 degrees. In some embodiments, as shown in FIG. 3D, an entire part from the bent portion 331 to the mating segment 31 is the first flat portion 33*a*, and an entire part from the bent portion 331 to the holding segment 32 is the second flat portion 33*b*. In this case, the bent segment 33 may have only one bent portion 331.

In some embodiments, the bent segment 33 may have more than one bent portion 331, and the channel axial direction 31-D of the passage 311 is caused to be not parallel to the holding axial direction 32-D.

In some embodiments, the bent portion 331 may be at a center of the bent segment 33 or off center. In other words, in some embodiments, lengths (lengths in the mating axial direction 31-D and the holding axial direction 32-D respectively) of the first plane 33*a* and the second plane 33*b* on the two sides of the bent portion 331 may be the same or different. In some embodiments, at least one of the length of the first plane portion 33*a* in the mating axial direction 31-D and the length of the second plane portion 33*b* in the holding axial direction 32-D is not zero. In other embodiments, as shown in FIG. 3D, neither the length L1 of the first plane portion 33*a* in the mating axial direction 31-D nor the length L2 of the second plane portion 33*b* in the holding axial direction 32-D is zero. In other words, the bent portion 331 is directly connected neither to the mating segment 31 nor the holding segment 32. In some embodiments, a ratio of the length L1 of the first plane portion 33*a* in the mating axial direction 31-D to the length L2 of the second plane portion 33*b* in the holding axial direction 32-D may be 1:1.8 to 1.8:1, or may be 1:1.5 to 1.5:1.

In some embodiments, as shown in FIG. 3C, in a direction perpendicular to the mating axial direction 31-D and parallel to the first plane portion 33*a* (for example, an up-down direction parallel to the paper surface in FIG. 3C), a width W1 of the bent segment 33 is greater than a width W2 of the mating segment 31. In other words, in some embodiments, in the direction perpendicular to the mating axial direction 31-D and parallel to the first plane portion 33*a*, the width of the bent segment 33 is greater than a width of the passage 311. In some embodiments, the width W1 of the first plane portion 33*a* is greater than the width W2 of the mating segment 31. In this case, a width of the first plane portion 33*a* is greater than the width of the passage 311.

Still referring to FIG. 3A, in some embodiments, a junction between the bent segment 33 and the mating segment 31 may have a wing portion 34 (or referred to as a side wing structure); and/or a wing portion 34 (or referred to as a side wing structure) may exist between the bent segment 33 and the holding segment 32. The wing portion 34 may have a curved surface. When the wing portion 34 is provided, a connection portion between the bent segment 33 and other segments can be smoothly connected, so that the entire female terminal 3 has higher structural strength.

In some embodiments, for example, as shown in FIG. 3A, the mating segment 31 for accommodating the male terminal may have a pair of channels with a substantially U-shaped cross-section (for example, two opposite U-shaped channels 4 on the left and the right shown in FIG. 4A, and other details are to be described in detail later). The two channels together form a passage 311, and a slit may exist between the two channels. The passage 311 may be a substantially rectangular channel (that is, a cross-section of the channel is substantially rectangular) or may have other shapes. In some embodiments, referring to FIG. 4A, FIG. 4B, and FIG. 5 below, each of the channels has a base wall, an upper side wall extending from the base wall, and a lower side wall extending from the base wall. In some embodiments, as shown in FIG. 4B, for example, the lower side wall of each of the channels may be connected to the bent segment 33. However, it should be noted that the structure of the mating segment 31 of the female terminal 3 is not limited thereto, and may be any structure having a passage, provided that the channel can accommodate a part of the male terminal and get in contact with the male terminal.

In some embodiments, as shown in FIG. 3A, when the lower side wall of each of the channels is connected to the bent segment 33, one side of the wing portion 34 connecting the mating segment 31 and the bent segment 33 may be connected to the base wall of the mating segment 31, and the other side is connected to the bent segment 33.

In some embodiments, the accommodation channel 321 of the holding segment 32 for accommodating the wire has a convex tail 322 that may be in contact with or crimped to a bare conductive core of the wire 13. In some embodiments, an inner side or an outer side of the accommodation channel 321 may have a concave-convex structure to enhance an effect of holding the conductive core.

According to the female terminal structure with the bent segment 33, a desired angle may exist between the axial direction 31-D of the male terminal to be subsequently mounted to the female terminal 3 and the holding axial direction 32-D of the circuit connecting segment 32. In this way, an outgoing direction of the wire of the connector 1 formed by using the female terminal can be more flexibly adjusted.

The present disclosure further provides a terminal structure that can be applied to the mating segment of the female terminal for mating with the male terminal.

Figure 4A:
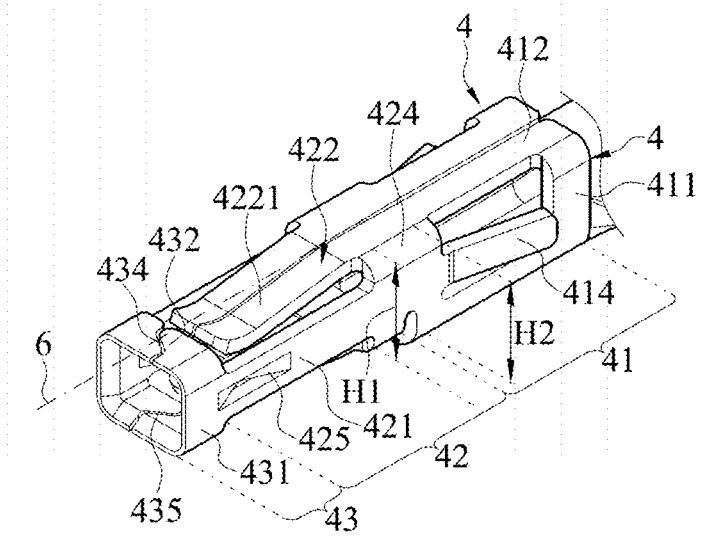
FIG. 4A is a three-dimensional schematic diagram of a mating segment of a female terminal according to some embodiments of the present disclosure.
Figure 4B:
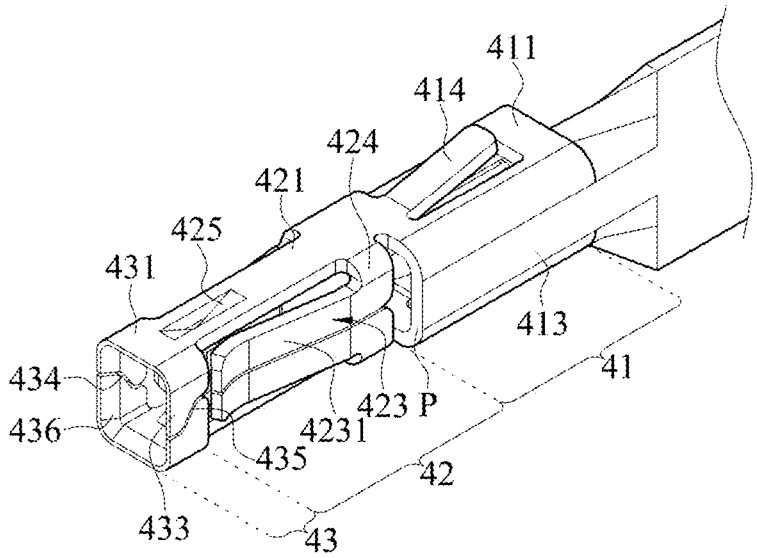
FIG. 4B is a three-dimensional schematic diagram of the female terminal in FIG. 4A viewed from another angle.

Referring to FIG. 4A and FIG. 4B, FIG. 4A is a three-dimensional schematic diagram of the mating segment of the female terminal for mating with the male terminal viewed from an upper side wall thereof according to some embodiments; and FIG. 4B is a three-dimensional schematic diagram of the mating segment shown in FIG. 4A viewed from a lower side wall. In FIG. 4A and FIG. 4B, other parts such as the holding segment of the female terminal for accommodating the wire are omitted and not shown in the figure.

Referring to FIG. 4A, in some embodiments, the mating segment includes a pair of channels 4. A cross-section of each of the channels 4 may be substantially U-shaped. The pair of channels 4 can form a passage together by mating U-shaped openings, and the channel may be configured to accommodate at least a part of the male terminal subsequently.

Still referring to FIG. 4A, in some embodiments, each of the channels 4 may have a base wall, an upper side wall extending upward from the base wall, and a lower side wall extending downward from the base wall. Each of the channels 4 may be divided into a base part 41, a port part 43, and a connection part 42 connecting the base part 41 and the port part 43. The male terminal to be subsequently inserted enters the female terminal from the port part 43.

The base part 41, the connection part 42, and the port part 43 are sequentially described based on FIG. 4A and FIG. 4B. As shown in FIG. 4A and FIG. 4B, in some embodiments, a base wall 411 of the base part 41 has a backstop arm 414 protruding toward outside of the passage. A width of the backstop arm 414 is less than a width of the base wall 411 of the base part. In addition, in some embodiments, the backstop arm 414 has a fixed end and a suspending end. The fixed end is connected to the base wall 411 of the base part 41. The fixed end is closer to the port part 43 than the suspending end. However, in some embodiments, the mating accommodation channel of the insulative housing 11 in FIG. 1 may fit the backstop arm 414. A backstop groove is disposed in the mating accommodation channel, so that after the mating segment is inserted into the mating accommodation channel, the backstop arm 414 is engaged into the backstop groove to prevent the mating segment of the female terminal from exiting the mating accommodation channel (which is further described later).

In some embodiments, as shown in FIG. 4B, the lower side wall 413 of the base part 41 and a lower side wall 413 of a base part 41 of another opposite channel 4 may be connected to each other. Therefore, in the embodiments, the bottom of the base part 41 may be considered as a closed ring wall, so that the entire mating segment has better structural strength and is more stably connected to other parts of the female terminal.

Next, the connection part 42 is described. In some embodiments, a base wall 421 of the connection part 42 is connected to the base wall 411 of the base part 41. In some embodiments, an upper side wall 422 and a lower side wall 423 of the connection part 42 may respectively have cantilever contact components 4221 and 4231 connected to the base wall 421 of the connection part 42. The cantilever contact components 4221 and 4231 extend toward the port part 43 along the passage axial direction. In the embodiment shown in FIG. 4A and FIG. 4B, the cantilever contact components 4221 and 4231 are connected to the base wall 421 through a connecting component 424. In some embodiments, the connecting component 424 is connected to the ends of the cantilever contact components 4221 and 4231 away from the port part 43. In addition, in some embodiments, as shown in FIG. 4A, the cantilever contact component 4221 of the upper side wall 422 is connected to the upper side wall 412 of the base part 41.

In some embodiments, as shown in FIG. 4A, the connecting component 424 connecting the cantilever contact component 4221 of the upper side wall and the base wall 421 may be connected to the base wall 411 of the base part 41. In this implementation, a part of the connecting component 424 may also be considered as a part of the base wall 421 of the connection part.

In some embodiments, the cantilever contact components 4221 and 4231 have an arc-shaped cross-section bent toward inside of the passage, that is, the cantilever contact components 4221 and 4231 bent toward the inside of the passage to form a contact portion to be subsequently in contact with the male terminal. It should be noted that the "arc-shaped" herein may be any curved line segment, for example, a V-shaped or U-shaped line segment, etc. In some embodiments, the contact portion of the cantilever contact component may be a lowest point of the arc-shaped cross-section.

In some embodiments, upper and lower cantilever contact components 4221 and 4231 in the connection part 42 of a single channel 4 form a first holding pair, but the present disclosure is not limited to one pair. For example, in other embodiments, in the connection part 42 of the single channel 4, another pair of upper and lower cantilever contact components may be formed in the connection part 42 of the single channel 4 by shortening lengths of the cantilever contact components 4221 and 4231.

In some embodiments, contact positions of upper and lower cantilever contact components 4221 and 4231 in a connection part 42 of one channel 4 may correspond to each other, or may be staggered from each other. In other words, distances between contact portions of the upper and lower cantilever contact components 4221 and 4231 and the port part 43 may be the same or different from each other.

Figure 4C:
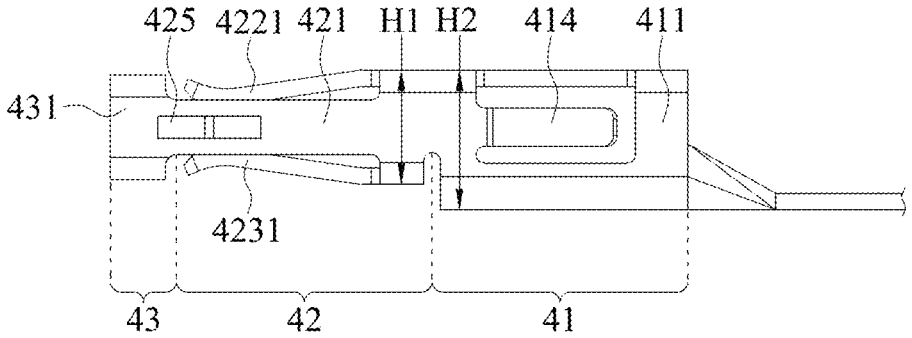
FIG. 4C is a side view of the female terminal in FIG. 4A.

As shown in FIG. 4A and FIG. 4C (FIG. 4C is a side view of FIG. 4A), in some embodiments, a height H1 of the base wall 421 of the connection part 42 is less than a height H2 of the base wall 411 of the base part 41. The height difference causes an end surface P of the lower side wall 413 of the base part 41 to be exposed (which is, for example, shown in FIG. 4B or FIG. 5). In some embodiments, the mating accommodation channels 111*a* and 111*b* of the insulative housing 11 in FIG. 1 may fit the exposed end surface P. Blockers 111*a*1 and 111*b*1 are disposed in the mating accommodation channels 111*a* and 111*b* (which is, for example, shown in FIG. 18B), so that when the mating segment is inserted into the mating accommodation channels 111*a* and 111*b*, the end surface P of the lower side wall 413 of the base part 41 abuts against the blockers 111*a*1 and 111*b*1 to prevent the mating segment from continuing being inserted forward (to be described later).

Figure 4D:
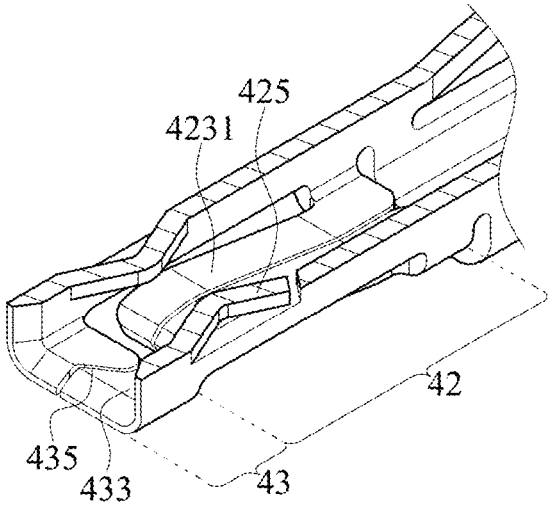
FIG. 4D is a three-dimensional cross-sectional view of the mating segment of the female terminal along a line 7-7 in FIG. 5 according to some other embodiments of the present disclosure.

In some embodiments, the base wall 421 of the connection part 42 or a base wall 431 of the port part has a convex structure 425 protruding toward the inside of the passage. The convex structure 425 may also span the port part 43 and the connection part 42. The convex structure 425 may be formed through stamping from the base wall at a desired position into the passage. In some embodiments, the convex structure 425 may be connected to the base wall at both ends, that is, both ends are fixed ends. As shown in FIG. 4D (FIG. 4D is a three-dimensional cross-sectional view of the mating segment of the female terminal along a line 7-7 in FIG. 5 according to some embodiments), an end of the convex structure 425 close to the port part 43 is a fixed end, and an end away from the port part 43 is a suspending end.

In some embodiments, an apex portion of the convex structure 425 may be a contact portion to be subsequently in contact with the male terminal. In some embodiments, convex structures 425 respectively formed on the pair of channels 4 are a second holding pair, which may correspond to each other or staggered from each other. The "correspond" in this paragraph may mean that distances between the two contact portions and a frame port 5 of the port part 43 are the same.

Next, the port part 43 is described. In some embodiments, the port part 43 and the connection part 42 may be distinguished by using respective upper side walls isolated from each other. In other words, in some embodiments, as shown in FIG. 4A and FIG. 4B, an upper cantilever contact component 4221 of each channel 4 is not connected to an upper side wall 432 of the port part, and/or a lower cantilever contact component 4231 of each channel 4 is not connected to a lower side wall 433 of the port part. The base wall 431 of the port part 43 is connected to the base wall 421 of the connection part 42, and a port part 43 of one channel 4 and a port part 43 of another channel 4 together form a frame port 5 (referring to FIG. 5). In the embodiments shown in FIG. 4A and FIG. 4B, the frame port 5 may be considered as a cuboid with a passage.

In some embodiments, an upper side wall frame port slit 434 is formed between an upper side wall 432 extending from a base wall 431 of the port part 43 and an upper side wall 432 extending from a base wall 431 of the port part 43 of another channel 4. A lower side wall frame port slit 435 is formed between a lower side wall 433 extending from the base wall 431 of the port part 43 and a lower side wall 433 extending from the base wall 431 of the port part 43 of another channel 4. The frame port slit between the port parts 43 of the two channels 4 may cause the mating segment to be slightly isolated toward two sides during mating between the entire mating segment and the male terminal, so as to more flexibly accommodate the male terminal.

In some embodiments, the entire frame port 5 may be considered to be divided into two parts: left and right parts by the upper side wall frame port slit 434 and the lower side wall frame port slit 435. In some embodiments, the frame port 5 is composed of only two parts, that is, respective port parts 43 of a pair of channels 4. An upper side wall 432, a base wall 431, and a lower side wall 433 of the port part are connected in sequence without disconnection.

Figure 5:
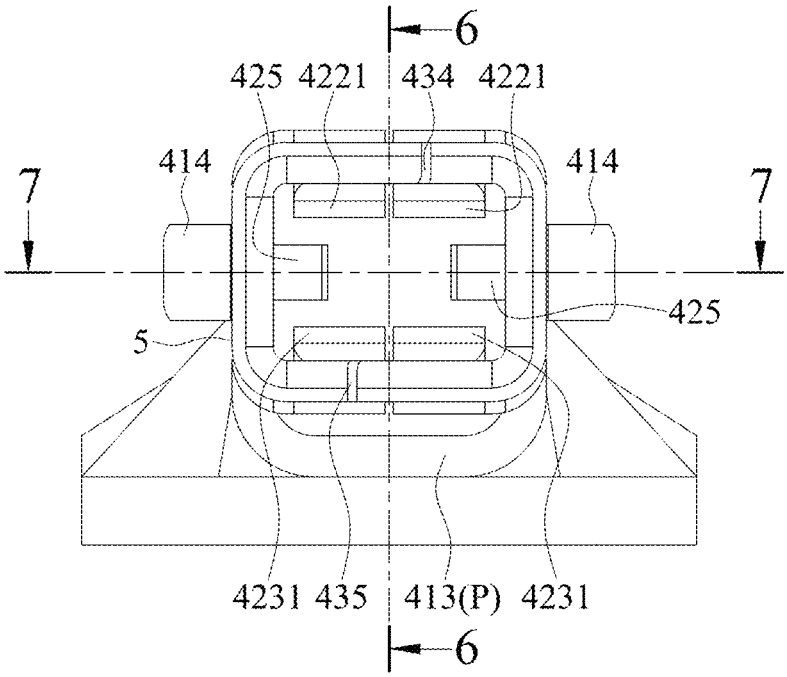
FIG. 5 is a front view of observing a base part from a port part of the female terminal according to FIG. 4A.

Each of the frame port slits has an opening portion at two ends of the frame port 5, one is an inner opening close to the connection part 42 and the other is an outer opening away from the connection part 42. In some embodiments, referring to FIG. 5 (FIG. 5 is a front view of observing the base part 41 from the port part 43 according to FIG. 4A), the frame port 5 may have a symmetry plane. The outer opening portion of the upper side wall frame port slit 434 is not on the symmetry plane of the frame port 5, and/or the outer opening portion of the lower side wall frame port slit 435 is not on the symmetry plane of the frame port 5.

In some embodiments, as shown in FIG. 4A and FIG. 4B, the two opening portions of each of the frame port slit are located on opposite sides of the symmetry plane of the frame port 5. In some embodiments, at least one of the upper side wall frame port slit 434 and the lower side wall frame port slit 435 is non-linear, for example, may be curved, and in some embodiments, may be substantially S-shaped. In addition, in some embodiments, the upper side wall frame port slit 434 and the lower side wall frame port slit 435 are not plane-symmetrical with each other (that is, there is no symmetry plane between the upper side wall frame port slit 434 and the lower side wall frame port slit 435). The outer opening of the frame port slit is away from a center line, at least one frame port slit is non-linear, and/or the upper side wall frame port slit 434 and the lower side wall frame port slit 435 are not plane-symmetrical with each other, so that when the mating segment is to be subsequently inserted into other slots, the frame port slit is unlikely to be inserted into a slot wall between slots, or even if the frame port slit is inserted into the slot wall, the female terminal is not diverged and damaged as a result of excessive insertion.

Still referring to FIG. 4A, in some embodiments, since a pair of channels 4 are bilaterally symmetrical, a passage vertical cross-section passing through a slit formed between the upper side walls 412 of the base parts 41 overlaps the symmetry plane of the frame port. In some embodiments, two openings of a single frame port are located on opposite sides of a symmetry plane of the frame port. In some embodiments, as shown in FIG. 4A, an extending direction 6 of the slit formed between the upper side walls 412 of the base parts 41, if projected on a plane on which the upper side wall frame port slit 434 is located, is not parallel to the upper side wall frame port slit 434.

It may be learned from FIG. 5 that, in some embodiments, the single channel 4 of the mating segment may have three contact portions (located on the upper and lower cantilever contact components 4221 and 4231 and the convex structure on the base wall 425, respectively) in contact with the male terminal. Therefore, the entire mating segment has six contact portions. The contact portion is described below with reference to such an embodiment. However, it should be noted that, as described above, a number of contact portions is not limited thereto.

Figure 6:
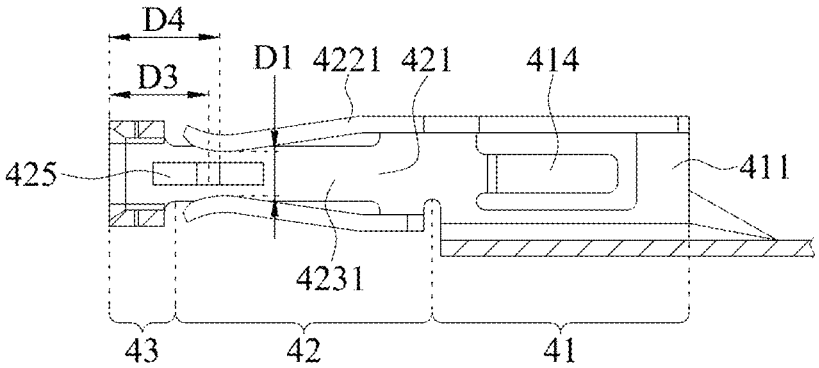
FIG. 6 is a cross-sectional view of the mating segment of the female terminal along a line 6-6 in FIG. 5.
Figure 7:
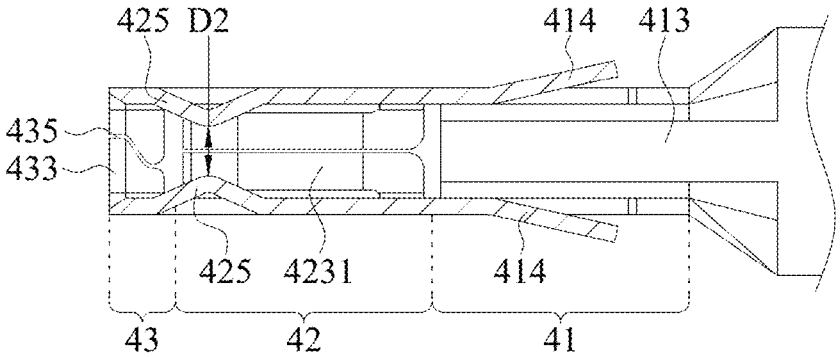
FIG. 7 is a cross-sectional view of the mating segment of the female terminal along a line 7-7 in FIG. 5.
Figure 8:
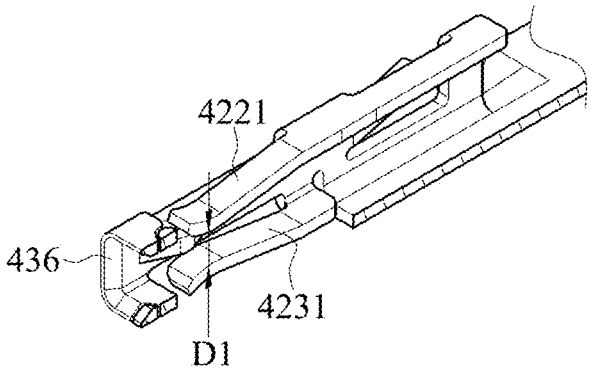
FIG. 8 is a three-dimensional schematic diagram of a female terminal shown in FIG. 6.
Figure 9:
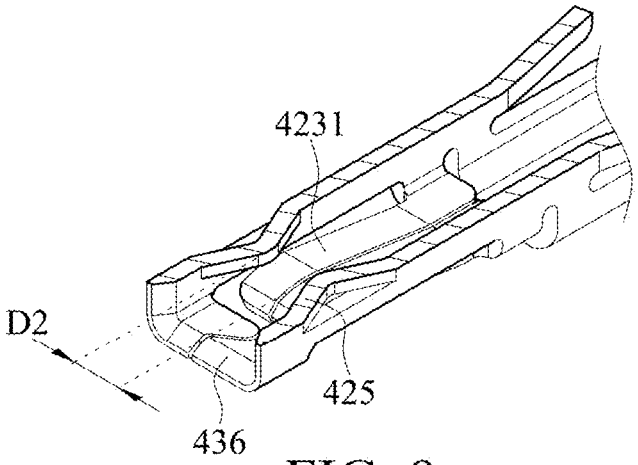
FIG. 9 is a three-dimensional schematic diagram of a female terminal shown in FIG. 7.

Referring to FIG. 6, FIG. 7, FIG. 8, and FIG. 9, FIG. 6 is a cross-sectional view of the mating segment of the female terminal along a line 6-6 in FIG. 5; FIG. 7 is a cross-sectional view of the mating segment of the female terminal along a line 7-7 in FIG. 5; and FIG. 8 and FIG. 9 are three-dimensional schematic diagrams of FIG. 6 and FIG. 7, respectively.

As shown in FIG. 6, in some embodiments, a maximum distance D4 (a distance to the leftmost side in FIG. 6) between a narrowest position of a pair of cantilever contact components 4221 and 4231 (for example, a position for calculating a distance D1 in FIG. 6) and the frame port 5 is greater than a maximum distance D3 (a distance to the leftmost side in FIG. 7) between a narrowest position of a pair of convex structures 425 (for example, a position for calculating a distance D2 in FIG. 7) and the frame port 5. In other words, compared to lowest points of the arc-shaped cross-sections of the cantilever contact components 4221 and 4231, a most convex point that is of the convex structure 425 located on a channel 4 same as a channel on which the cantilever contact components 4221 and 4231 are located and that is closest to an inner side of the channel is closer to the frame port 5. In this way, during insertion of the male terminal, it is not necessary to get in contact with all of the cantilever contact components 4221 and 4231 and the convex structure 425, so that the insertion process is smoother.

Referring to FIG. 6, FIG. 7, FIG. 8, and FIG. 9, in some embodiments, a shortest distance D1 between a cantilever contact component 4221 on an upper side wall and a cantilever contact component 4231 on a lower side wall on one channel 4 is greater than a shortest distance D2 between convex structures 425 of a pair of channels 4. In other words, the shortest distance D1 between the first holding pair is greater than the shortest distance D2 between the second holding pair. In some embodiments, the shortest distance D1 between the first holding pair may be 0.90 mm to 1.10 mm, and the shortest distance D2 between the second holding pair may be 0.70 mm to 0.90 mm. In some embodiments, according to different structural characteristics, different distances may exist between the first holding pair and the second holding pair. For example, since the cantilever contact components 4221 and 4231 are more flexible than the convex structure 425, the cantilever contact components 4221 and 4231 can be relatively close to each other, but the present disclosure is not limited thereto. The shortest distance D1 and the shortest distance D2 may also be the same, for example 0.7-1.0 mm.

In some embodiments, as shown in FIG. 4B, FIG. 8, and FIG. 9, in order to more smoothly insert the male terminal into the mating segment, a guide slope 436 may be disposed at an outer side of the frame port 5. In some embodiments, a guide slope 436 may be disposed at only one side, a part of one side, or all four sides of the frame port 5.

In some embodiments, the mating segment of the above female terminal with the bent segment may also use the mating segment structure described herein. In other words, in the mating segments shown in FIG. 4A and FIG. 4B, the base part 41 may be connected to the bent segment 33 of the female terminal 3 to form the female terminal 3 similar to that shown in FIG. 3B.

The present disclosure further provides a connector 1 using the female terminal with the bent segment. The above female terminal 3 with the bent segment 33 shown in FIG. 3B, for example, is applied to the connector 1 that can be mated with the female terminal 3, so that an angle exists between an axis of the male terminal to be subsequently inserted into the female terminal 3 and an axis of a wire, thereby meeting more types of wiring requirements.

Referring to FIG. 1, FIG. 1 is a schematic exploded view of a connector 1 using a female terminal with a bent segment provided in the present disclosure according to some embodiments.

It should be noted that, for brevity of the following descriptions, in descriptions of the connector 1, mating segments of female terminals 3 and 12 used in the drawings of the present disclosure (for ease of description, an element symbol of a female terminal not assembled to the insulative housing 11 is 3, and an element symbol of a female terminal assembled to the insulative housing 11 is 12) both have a specific structure. However, the structure of the mating segment of the female terminal 12 used in the connector 1 of the present disclosure is not limited thereto, and may be any structure with a passage, provided that the channel can accommodate a part of the male terminal and get in contact with the male terminal.

Referring to FIG. 1, in some embodiments, the connector 1 may include an insulative housing 11, a female terminal 12 with a bent segment (a bending angle herein is approximately 90 degrees, that is, an angle between a mating axial direction 31-D of the female terminal 12 and a holding axial direction 32-D is approximately 90 degrees), a wire 13 disposed on a holding segment of the female terminal 12, and a cover component 15.

The insulative housing 11 has mating accommodation channels 111*a* and 111*b* and a holding accommodation channel 113. The mating accommodation channels 111*a* and 111*b* are in communication with the holding accommodation channel 113. It should be noted that although an angle existing between the mating accommodation channels 111*a* and 111*b* and the holding accommodation channel 113 shown in FIG. 1 is approximately 90 degrees, the angle between the mating accommodation channels 111*a* and 111*b* and the holding accommodation channel 113 is not limited to 90 degrees. In some embodiments, the angle between the mating accommodation channels 111*a* and 111*b* and the holding accommodation channel 113 may be 45 degrees to 90 degrees.

The mating segment of the female terminal 12 is disposed in the mating accommodation channels 111*a* and 111*b*, and the holding segment of the female terminal 12 and the wire 13 disposed on the holding segment are disposed in the holding accommodation channel 113.

Figure 14A:
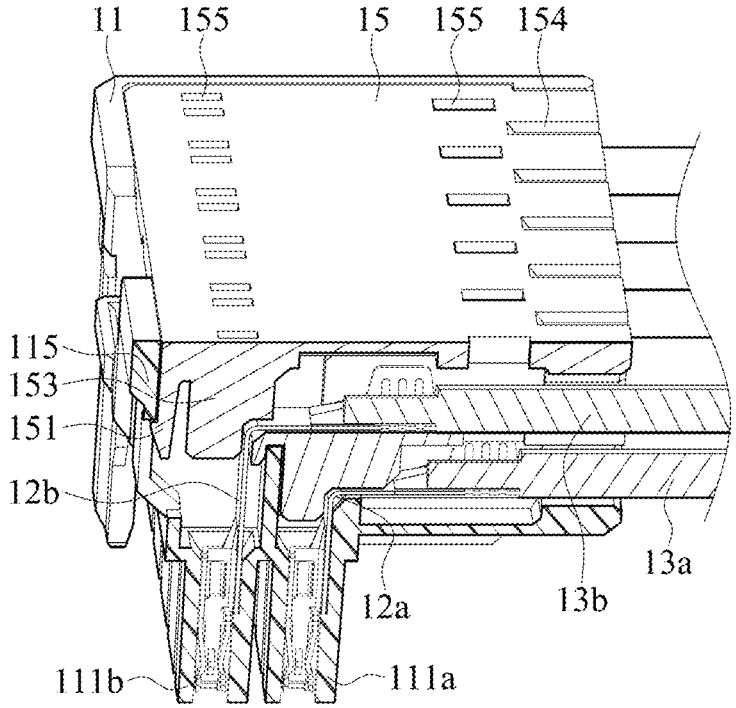

The cover component 15 may be covered on the insulative housing 11, and may at least partially fix the female terminal 12 and the wire 13 in the insulative housing 11. In some embodiments, for example, as shown in FIG. 14A and FIG. 26C below, the cover component 15 has a buckling convex portion 151. The buckling convex portion 151 may abut against a buckling shoulder 115 on the insulative housing 11 to engage the cover component 15 and the insulative housing 11.

In some embodiments, for example, as shown in FIG. 1, in order to more stably connect the cover component 15 and the insulative housing 11, the connector 1 may include a fixing bolt 16. In some embodiments, the fixing bolt 16 may pass through the cover component 15 to be engaged with the insulative housing 11 (an overall structure is further described later). The fixing bolt 16 may be disposed between adjacent wires 13 to further prevent the cover component 15 from being detached from the insulative housing 11 as a result of pulling of the wire 13.

It should be noted that, in FIG. 1, although the insulative housing 11 has a plurality of mating accommodation channels 111*a* and 111*b* and a plurality of holding accommodation channels 113, numbers thereof are not limited thereto. In some embodiments, the insulative housing 11 may also have only one mating accommodation channel and one holding accommodation channel, and accommodate one female terminal 12 and one wire 13.

According to the above structure of the connector 1, a desired angle may exist between the axis of the male terminal to be subsequently inserted into the female terminal 12 and the axis of the wire 13, so that an original outgoing direction of the wire 13 can be changed.

Still referring to FIG. 1, in some embodiments, the insulative housing 11 may include a plurality of mating accommodation channels 111*a* arranged in a row into a first mating accommodation channel row 111*a*'. The insulative housing 11 may also have a plurality of holding accommodation channels 113 of a number corresponding to a number of first mating accommodation channels 111*a'* in the first mating accommodation channel row 111*a*'. For example, in the embodiment shown in FIG. 1, the first mating accommodation channel row 111*a'* has six mating accommodation channels 111*a*, and also has six holding accommodation channels 113. In some embodiments, there may be only one female terminal 12 and one wire 13 disposed in one of the six mating accommodation channels 111*a* and the holding accommodation channels 113. There may also be three sets of female terminals 12 and wires 13 disposed in the holding accommodation channels 113 at intervals. In other words, a number of female terminals 12 and a number of wires 13 do not need to correspond to the number of mating accommodation channels 111*a* or holding accommodation channels 113.

Figure 23:
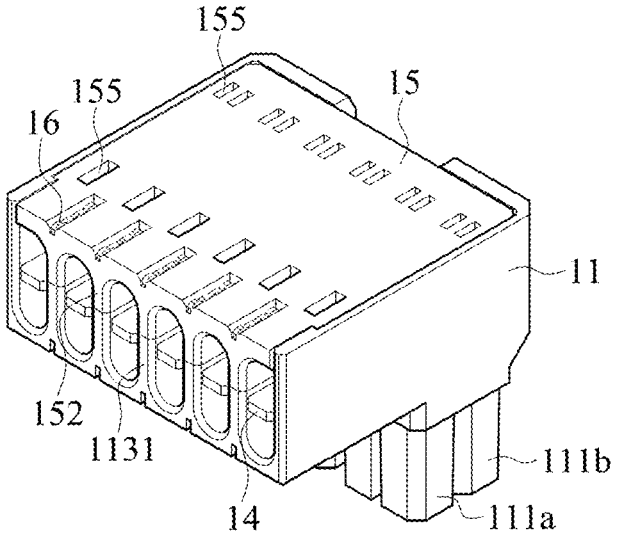
FIG. 23 is a three-dimensional schematic diagram of a connector according to some embodiments (a wire is omitted)

In some embodiments, as shown in FIG. 11A and FIG. 23 below, the plurality of holding accommodation channels 113 may have a holding accommodation channel isolation wall 1131 that may be configured to isolate the female terminals 12 and/or the wires 13. As shown in FIG. 23 and FIG. 26B below, in some embodiments, the cover component 15 may have a supporting plate 152 protruding downward or toward the insulative housing 11 to abut against the holding accommodation channel isolation wall 1131. In some embodiments, as shown in FIG. 11A below, a height of the holding accommodation channel isolation wall 1131 corresponding to the supporting plate 152 of the cover component 15 may be reduced, so that an upper surface of the cover component 15 to be subsequently mounted can be substantially flat.

In some embodiments, for example, as shown in FIG. 23 below, after the cover component 15 is engaged with the insulative housing 11, the supporting plate 152 protruding downward from the cover component 15 and the holding accommodation channel isolation wall 1131 together form a space for accommodating the wire 13. In other words, the cover component 15 may not have a through hole for the wire 13 to penetrate. Since a position through which the wire 13 penetrates the cover component 15 is not a closed through hole, during assembling of the cover component 15 to the insulative housing 11, wires 13 do not need to pass through the closed through hole of the cover component 15 one by one first. Instead, after the wires 13 are disposed on the insulative housing 11, the cover component 15 may be directly engaged with the insulative housing 11.

Still referring to FIG. 1, in some embodiments, the insulative housing 11 of the connector 1 includes a second mating accommodation channel row 111*b'* formed by some other second mating accommodation channels 111*b*. The second mating accommodation channel row 111*b'* may be arranged side by side with the first mating accommodation channel row 111*a*'. The second mating accommodation channel row 111*b'* may be flush with the first mating accommodation channel row 111*a*'. In some cases, the second mating accommodation channel row may also be staggered with the first mating accommodation channel row 111*a'*. The second mating accommodation channel row 111*b'* is farther away from the holding accommodation channel 113 than the first mating accommodation channel row 111*a'*.

In some embodiments, a number of the second mating accommodation channels 111*b* in the second mating accommodation channel row 111*b'* may not necessarily be the same as a number of the first mating accommodation channels 111*a* in the first mating accommodation channel row 111*a'*.

When there is the second mating accommodation channel row 111*b*', as shown in FIG. 1, the connector 1 can accommodate two columns of female terminals 12. The two columns of female terminals 12 may be isolated by an isolation plate 14 to avoid an electrical connection therebetween.

For example, in the embodiment shown in FIG. 1, a female terminal 12 disposed in the first mating accommodation channel row 111*a'* is a first female terminal 12*a*. A wire 13 connected to the first female terminal 12*a* is a first wire 13*a*. A female terminal 12 disposed in the second mating accommodation channel row 111*b'* is a second female terminal 12*b*. A wire 13 connected to the second female terminal 12*b* is a second wire 13*b*. An isolation plate 14 is disposed above the first mating accommodation channel row 111*a'* and the first wire 13*a*, and then the second female terminal 12*b* and the second wire 13*b* are disposed above the isolation plate 14. Then, the cover component 15 is disposed above the second female terminal 12*b* and the second wire 13*b*. In this case, the isolation plate 14 is disposed between the cover component 15 and the insulative housing 11.

It should be noted that two columns of mating accommodation channel rows 111*a'* and 111*b'* and two columns of female terminals 12 and wires 13 shown in FIG. 1 are merely for indicating that a number of terminals that can be accommodated in the connector 1 provided in the present disclosure can be expanded and that the present disclosure is not limited to the number shown in FIG. 1.

However, for brevity of description, manufacturing and a specific structure of a connector 1 is described by using the connector 1 shown in FIG. 1 (that is, the insulative housing 11 has two columns of mating accommodation channel rows 111*a'* and 111*b'* and two columns of female terminals 12 and wires 13, and each of the columns has six female terminals 12 and six wires 13) according to some embodiments.

Figure 10:
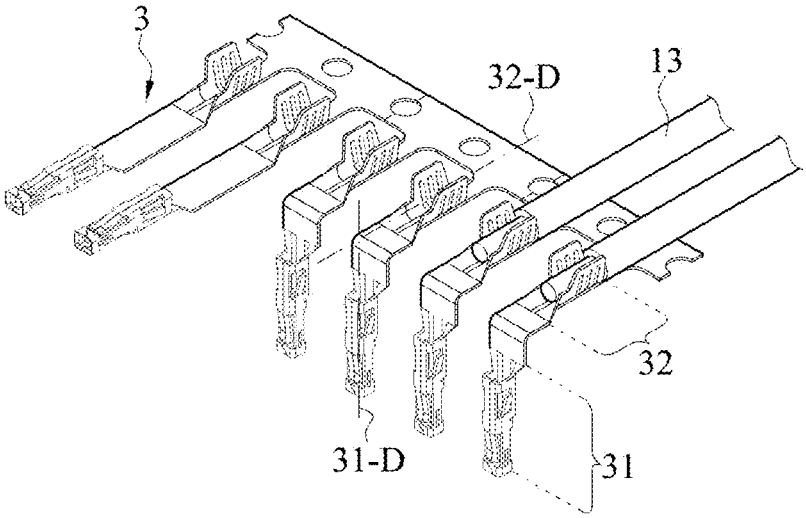
FIG. 10 is a schematic diagram of manufacturing of a female terminal according to some embodiments of the present disclosure.

Referring to FIG. 10, FIG. 10 is a schematic diagram of manufacturing of the female terminal 3 (that is, the female terminal 12 assembled in the connector 1). According to some embodiments, one column of unbent female terminals 3 (for example, a state of two leftmost female terminals 3 in FIG. 10) are first completed through, for example, stamping.

Then, the female terminal 3 having a bent segment is obtained through bending (for example, a state of two middle female terminals 3 in FIG. 10). In this case, the mating axial direction 31-D of the mating segment 31 of the female terminal 3 and the holding axial direction 32-D of the holding segment 32 are not parallel and intersect. Then, a conductive part of the wire 13 is disposed on the holding segment 32 (for example, a state of two rightmost female terminals 3 in FIG. 10) to obtain one column of bent female terminals 3 on which the wire 13 is disposed.

Figure 11B:
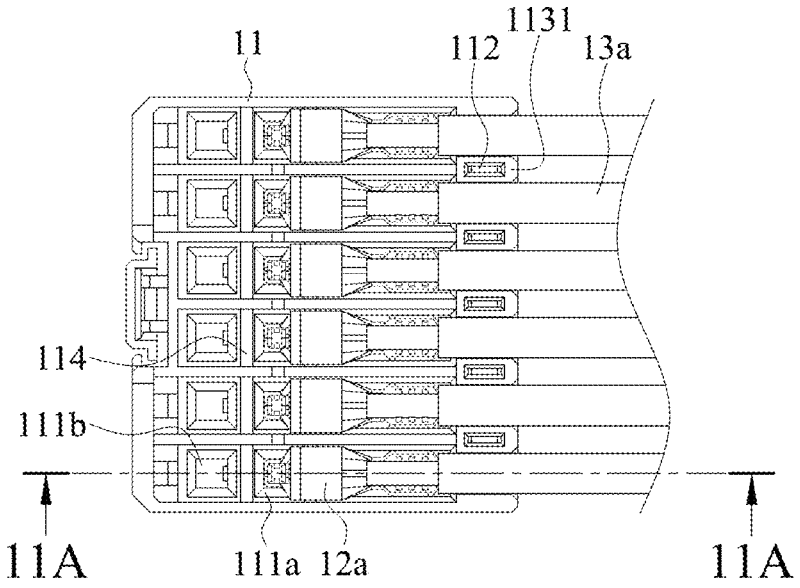

FIG. 11A, FIG. 11B, FIG. 12A, FIG. 12B, FIG. 13A, FIG. 13B, FIG. 14A, FIG. 14B, FIG. 15A, FIG. 15B, and FIG. 16A, FIG. 16B show cross-sections of the connector 1 according to some embodiments along the first wire 13*a* in various manufacturing steps and are top views corresponding to the steps (for example, FIG. 11A is a cross-sectional view along a line 11A-11A in FIG. 11B).

Referring to FIG. 11A and FIG. 11B, the mating segment of the bent female terminal 3 in FIG. 10 is disposed in the first mating accommodation channel 111*a* of the insulative housing 11, and the holding segment and the wire 13 thereof are disposed in the holding accommodation channel 113. During combination of the female terminal 3 and the insulative housing 11, the female terminals 3 each may be isolated and then assembled to the insulative housing 11 one by one.

As shown in FIG. 11A, in some embodiments, a mating accommodation channel row isolation wall 114 extending in a direction away from the mating accommodation channels 111*a* and 111*b* exists between the first mating accommodation channel row 111*a'* and the second mating accommodation channel row 111*b*', which may be configured to separate out a space for accommodating the first female terminal 12*a* and the second female terminal 12*b*. In addition, as shown in FIG. 11B, the holding accommodation channel isolation wall 1131 may have a bolt slot 112. In some embodiments, only a part of the holding accommodation channel isolation wall 1131 may have the bolt slot 112. When a fixing bolt 16 is used to further fix the cover component 15 and the insulative housing 11 in the connector, the fixing bolt 16 may pass through the cover component 15 to be inserted into the bolt slot 112 and engaged with the insulative housing 11 (the fixing bolt 16 is further described below).

Figure 12A:
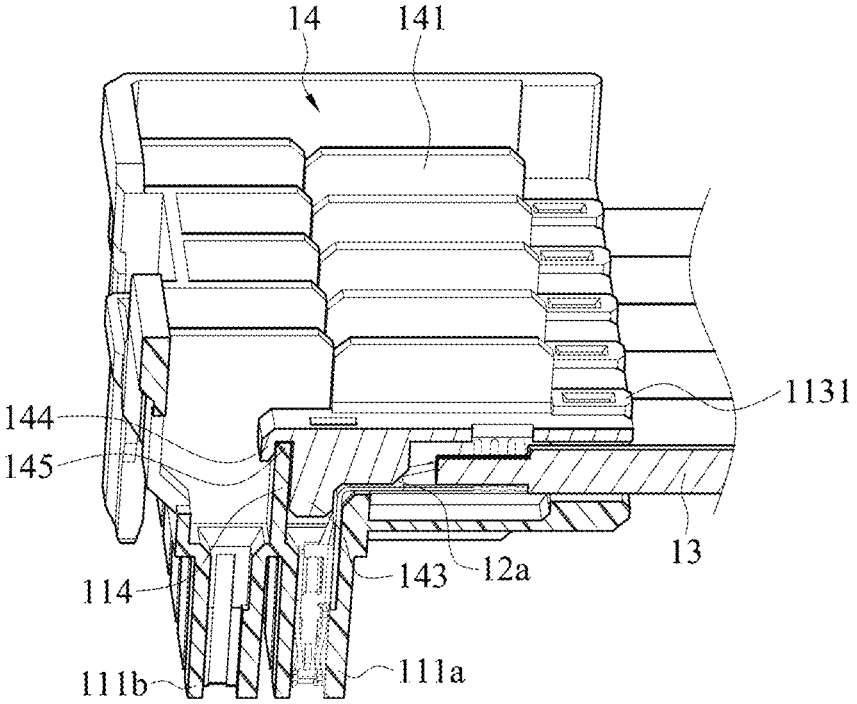
Figure 12B:
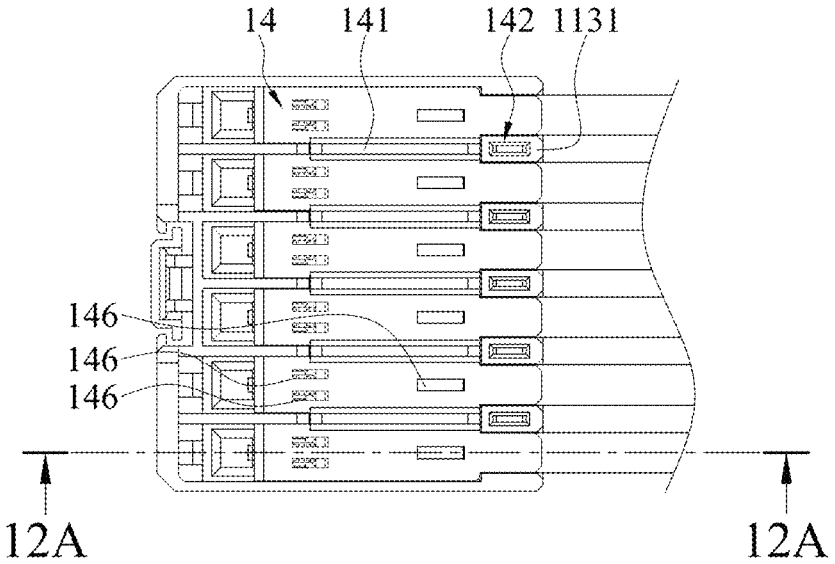

Next, referring to FIG. 12A and FIG. 12B, after the first column of female terminals 12*a* and first wires 13*a* are placed, the isolation plate 14 is disposed above the first female terminals 12*a* and the first wires 13*a*. It may be learned from FIG. 12B that, in a top view, the isolation plate 14 may cover the holding accommodation channel 113 and the first mating accommodation channel 111*a*, but does not cover the second mating accommodation channel 111*b*. In some embodiments, the holding accommodation channel isolation wall 1131 of the insulative housing 11 has a groove 1132 (referring to FIG. 11A) for accommodating the isolation plate 14 to be placed.

Still referring to FIG. 12A and FIG. 12B, in some other embodiments, the isolation plate 14 has an isolation sheet 141 protruding upward or toward the cover component 15. A position of the isolation sheet 141 may correspond to the holding accommodation channel isolation wall 1131. In this case, the isolation sheet 141 and the holding accommodation channel isolation wall 1131 may together form an isolation wall for separation between second female terminals 12*b* and between second wires 13*b* subsequently disposed (shown in FIG. 12B). In other words, in some embodiments, at least one second wire 13*b* is disposed between two adjacent isolation sheets 141 (shown in FIG. 13B). In some embodiments, in order not avoid excessive hindering of the engagement between the cover component 15 and the insulative housing 11, a height of an isolation sheet 141 above a disposed isolation plate 14 does not exceed a maximum height of the holding accommodation channel isolation wall 1131. In addition, in some embodiments, the isolation sheet 141 may not need to be disposed between all adjacent first female terminals 12*a*. In addition, widths or thicknesses of different isolation sheets 141 may not need to be the same.

Figure 12C:
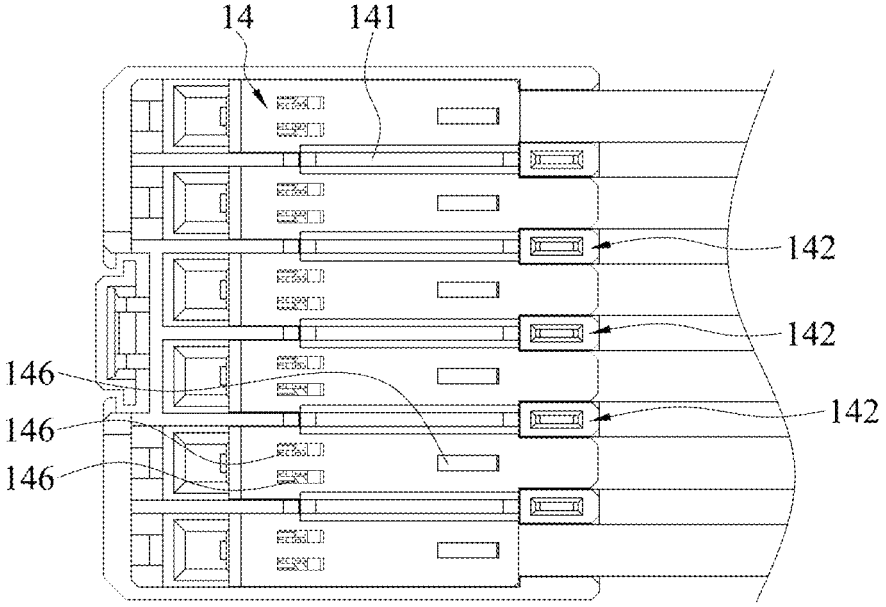
FIG. 12C is a top view of a connector in a specific step according to some embodiments of the present disclosure.
Figure 25A:
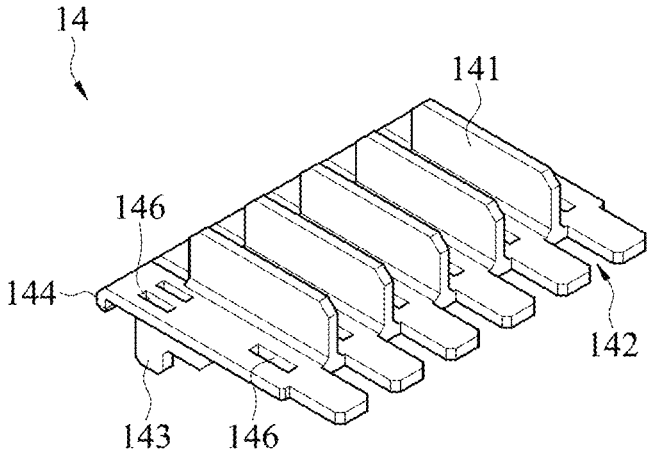
FIG. 25A and FIG. 25B are three-dimensional diagrams of an isolation plate at different angles according to some embodiments.
Figure 25B:
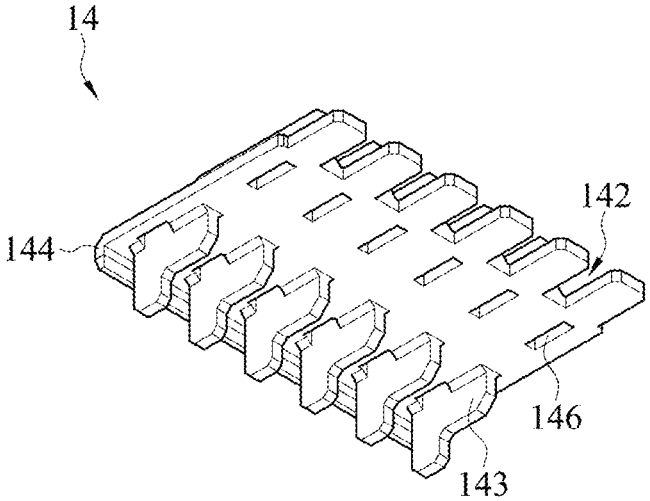

In some embodiments, as shown in FIG. 25A, FIG. 25B, and FIG. 12B, the isolation plate 14 may have an embedding slit 142 for accommodating the holding accommodation channel isolation wall 1131, which may be configured to further fix the isolation plate 14 on the insulative housing 11. A number of embedding slits 142 on the isolation plate 14 may be different from a number of holding accommodation channel isolation walls 1131. For example, as shown in FIG. 12C, the isolation plate 14 has only three embedding slits 142.

In some embodiments, as shown in FIG. 12A, a pressing sheet 143 (or referred to as a retaining portion) protruding downward or toward the female terminal 12 exists below the isolation plate 14. The pressing sheet 143 may be disposed in a communication space between the first mating accommodation channel 111*a* and the holding accommodation channel 113, and is configured to assist in fixing or retaining the first female terminal 12*a* below the isolation plate 14. In some embodiments, in order to better fix the lower first female terminal 12*a*, a shape of one side of the pressing sheet 143 matches a bending shape of a bent segment of the first female terminal 12*a*. In other words, in a side view, a shape of one side of the pressing sheet 143 is substantially the same as the shape of the bent segment of the first female terminal 12*a*. In some embodiments, one side of the pressing sheet 143 may be L-shaped.

Still referring to FIG. 12A, in some embodiments, an end of the isolation wall 14 close to the mating accommodation channel row isolation wall 114 has an end wall 144 extending downward. A holding space 145 is formed between the end wall 144 and the pressing sheet 143, which may be used to accommodate and/or be engaged with the mating accommodation channel row isolation wall 114. In this case, the mating accommodation channel row isolation wall 114 may be configured to support the isolation plate 14 or fix a position of the isolation plate 14.

In some embodiments, as shown in FIG. 12B, the isolation plate 14 may have a heat dissipation hole 146. For example, in the embodiment shown in FIG. 12B, each isolation plate 14 in the holding accommodation channel 113 has two heat dissipation holes 146 above the first female terminal 12*a* and one heat dissipation hole 146 above the conductive part of the first wire 13*a*. However, heat dissipation hole configuration in the present disclosure is not limited thereto.

Figure 13A:
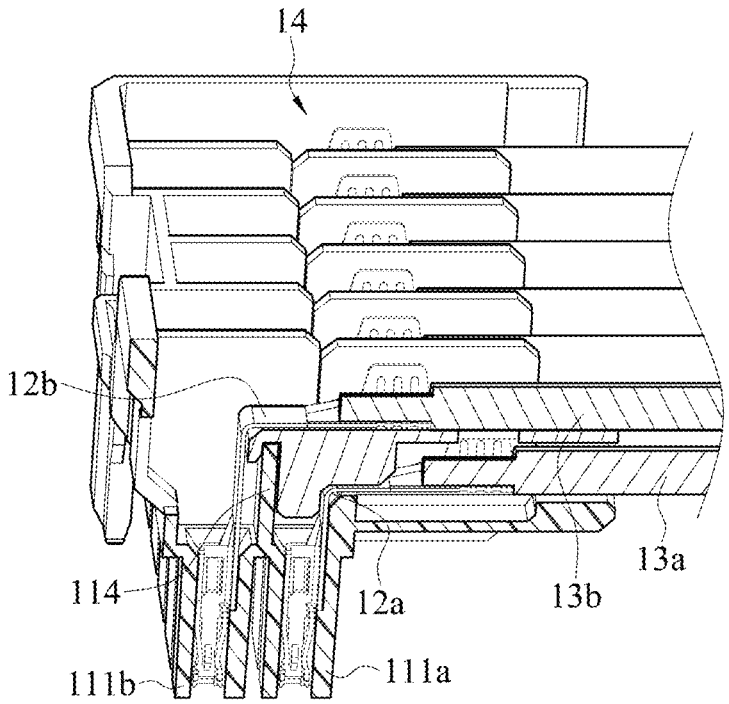
Figure 13B:
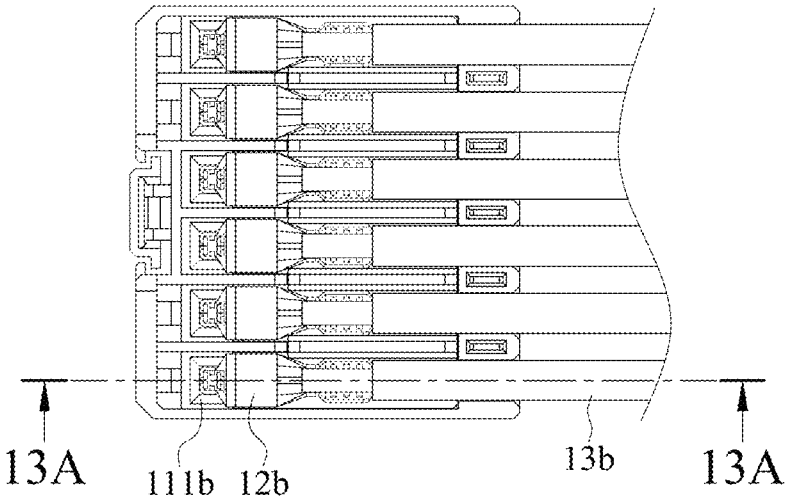

Next, referring to FIG. 13A and FIG. 13B, after the isolation plate 14 is disposed, the second column of second female terminals 12*b* are disposed above the isolation plate 14 in a manner substantially similar as the manner of disposing the first column of first female terminals 12*a*. In this case, a mating segment of the second female terminal 12*b* is disposed in the second mating accommodation channel 111*b*, and a holding segment of the second female terminal 12*b* and a second wire 13*b* are disposed above the isolation plate 14. In some embodiments, a holding axial direction of the first female terminal 12*a* is parallel to a holding axial direction of the second female terminal 12*b*. In some embodiments, the second wire 13*b* may be disposed between two adjacent isolation sheets 141.

Figure 13C:
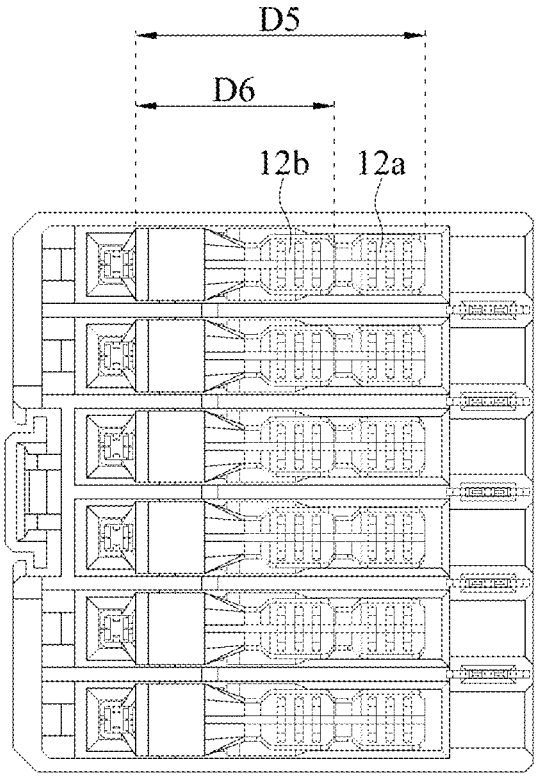
FIG. 13C is a top view of a connector in FIG. 13B omitting an isolation plate.

In some embodiments, the first wire 13*a* and the second wire 13*b* are located at one end in the insulative housing 11, and respective distances to the mating accommodation channel row isolation wall 114 in a top view are different. In some embodiments, the end at which the second wire 13*b* is located in the insulative housing 11 is closer to the mating accommodation channel row isolation wall 114 than the end at which the first wire 13*a* is located in the insulative housing 11 (referring to a distance D7 and a distance D8 in FIG. 17). Similarly, in the top view, a distance between the holding segment of the first female terminal 12*a* and the mating accommodation channel row isolation wall 114 is different from a distance between the holding segment of the second female terminal 12*b* and the mating accommodation channel row isolation wall 114. In some embodiments, as shown in FIG. 13C, a distance D5 between the holding segment of the first female terminal 12*a* and the mating accommodation channel row isolation wall 114 is greater than a distance D6 between the holding segment of the second female terminal 12*b* and the mating accommodation channel row isolation wall 114 (FIG. 13C is similar to the top view in FIG. 13B omitting the isolation plate 14, and for a position of the mating accommodation channel row isolation wall 114, referring to FIG. 11B).

In some embodiments, an overall length of the bent segment of the second female terminal 12*b* is different from an overall length of the bent segment of the first female terminal 12*a*. For example, the length of the bent segment of the second female terminal 12*b* may be greater than the length of the bent segment of the first female terminal 12*a*.

Figure 14B:
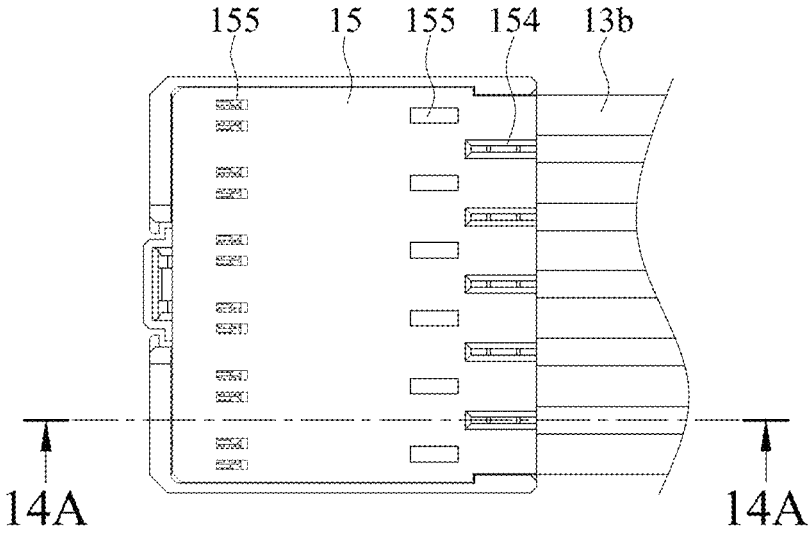
Figure 14C:
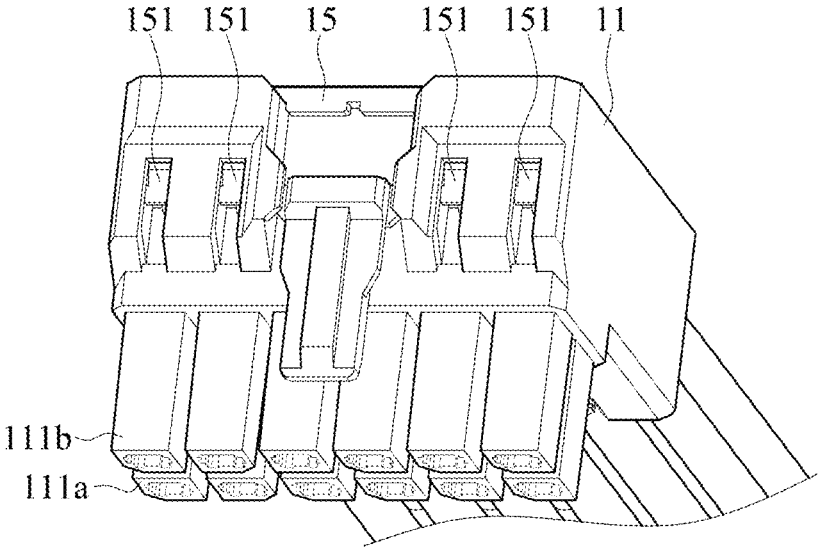
FIG. 14C is a three-dimensional schematic diagram of a back side of an insulative housing according to some embodiments.

Next, referring to FIG. 14A and FIG. 14B, after the second female terminal 12*b* and the second wire 13*b* are disposed, the cover component 15 may be mounted. In some embodiments, a tail end of the cover component 15 has a buckling convex portion 151. The buckling convex portion 151 may be engaged with a corresponding buckling shoulder 115 on the insulative housing 11. In other words, the buckling convex portion 151 may abut against the buckling shoulder 115 to prevent the cover component 15 from being detached (in some embodiments, for the buckling convex portion 151 of the cover component 15, referring to FIG. 26C). In some embodiments, as shown in FIG. 14C (FIG. 14C is a three-dimensional schematic diagram of a back side of the insulative housing 11 according to some embodiments), the buckling shoulder 115 of the insulative housing 11 may be a part of the heat dissipation hole of the insulative housing 11, that is, the buckling convex portion 151 of the cover component 15 is engaged with the heat dissipation hole of the insulative housing 11 and abuts against one side of the heat dissipation hole.

In some embodiments, the cover component 15 may have a heat dissipation hole 155. In the embodiment shown in FIG. 14B, the heat dissipation holes 155 of the cover component 15 correspond to the second wires 13*b* and the second female terminals 12*b*, respectively, but a number of the heat dissipation holes and positions for disposing the heat dissipation holes are not limited thereto.

In some embodiments, the cover component 15 may have a cover component pressing sheet 153 protruding downward or toward the insulative housing 11, and the cover component pressing sheet 153 may be disposed substantially corresponding to the second female terminal 12*b*. In some embodiments, in order to better fix the lower second female terminal 12*b*, a shape of one side of the cover component pressing sheet 153 matches the bending shape of the bent portion of the second female terminal 12*b*. In other words, in a side view, a shape of one side of the cover component pressing sheet 153 is substantially the same as the shape of the bent segment of the second female terminal 12*b*. In some embodiments, one side of the cover component pressing sheet 153 may be L-shaped.

Figure 26A:
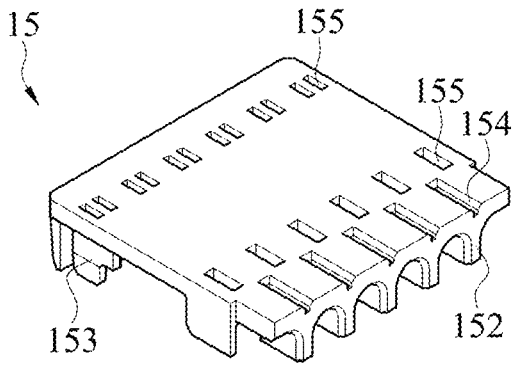
FIG. 26A, FIG. 26B, and FIG. 26C are three-dimensional diagrams of a cover component at different angles according to some embodiments.
Figure 26B:
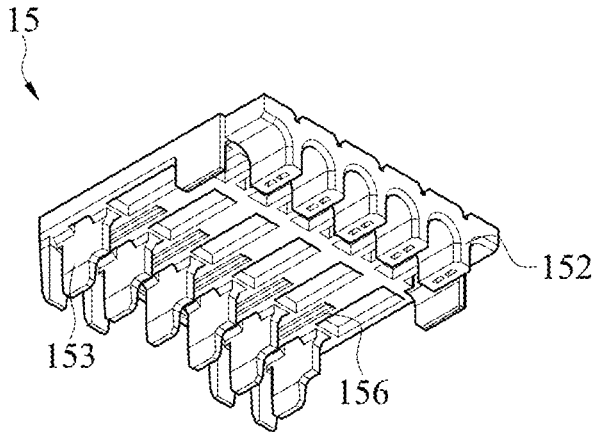
Figure 26C:
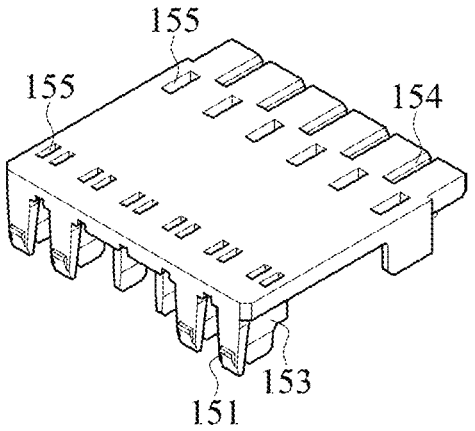

In some embodiments, as shown in FIG. 26A, the cover component 15 may have a bolt hole 154, which may be disposed corresponding to the bolt slot 112 in the holding accommodation channel isolation wall 1131. When a fixing bolt 16 is used to further fix the cover component 15 and the insulative housing 11, the fixing bolt 16 may pass through the bolt hole 154 of the cover component 15 and the bolt slot 112 in the holding accommodation channel isolation wall 1131 to engage the cover component 15 and the insulative housing 11.

An implementation of using the fixing bolt 16 on the connector 1 continues to be described below according to some embodiments.

Figure 15A:
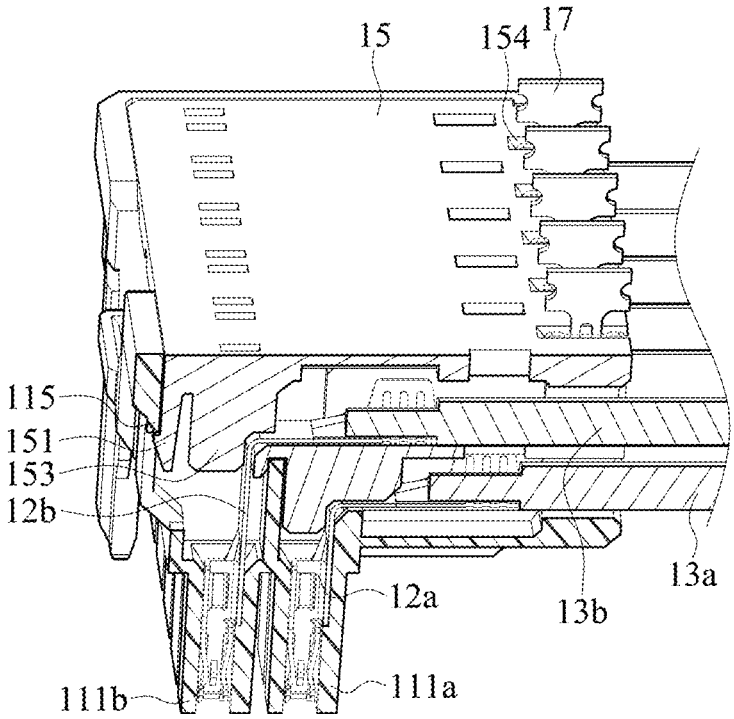
Figure 15B:
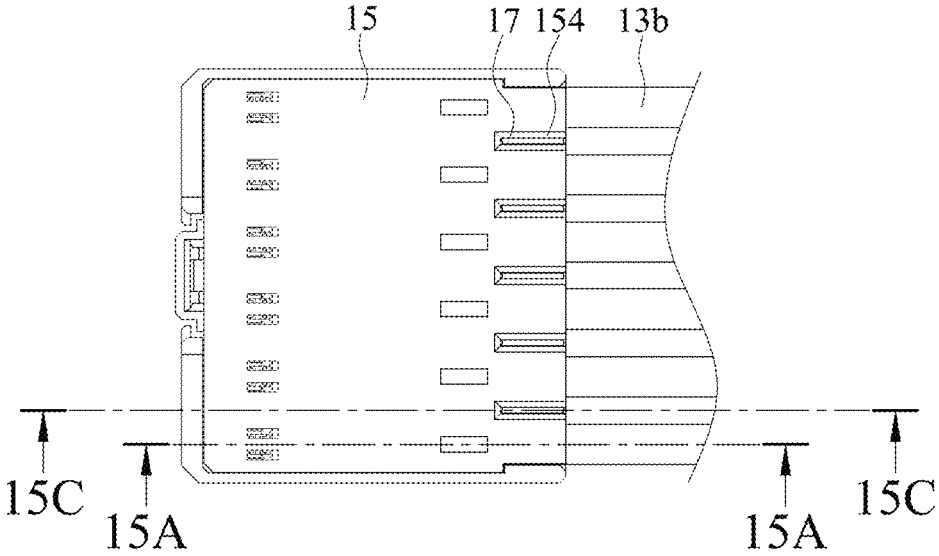

Referring to FIG. 15A and FIG. 15B, according to some embodiments, in order to facilitate mounting of the fixing bolt 16 onto the bolt hole 154 and the bolt slot 112, a fixing bolt assistance component 17 may exist at an upper part of the fixing bolt 16. The fixing bolt assistance component 17 is temporarily connected to the fixing bolt 16 and is removable later. The fixing bolt assistance component 17 helps conveniently push the fixing bolt 16 into the bolt slot 112 in the holding accommodation channel isolation wall 1131.

As shown in FIG. 15A, in some embodiments, the fixing bolt 16 with the fixing bolt assistance component 17 is inserted into the bolt slot 112 through the bolt hole 154 of the cover component 15. In this case, the fixing bolt 16 can be completely immersed in the connector 1, and at least a part of the fixing bolt assistance component 17 is exposed from the cover component 15.

Figure 15C:
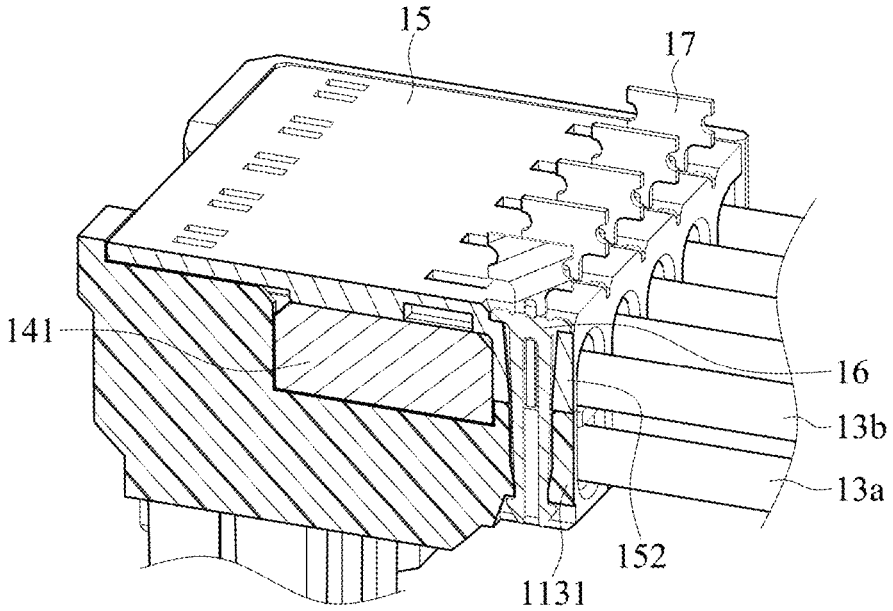
FIG. 15C is a three-dimensional cross-sectional view obtained according to a line 15C-15C in FIG. 15B.
Figure 15D:
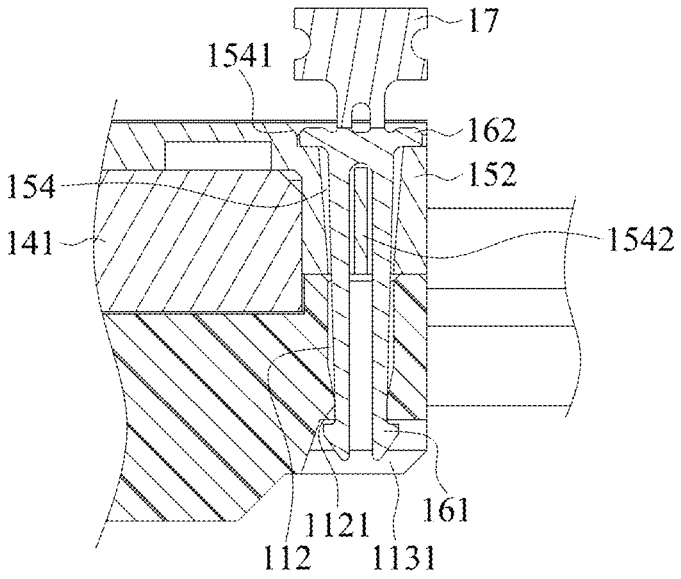
FIG. 15D is a partial enlarged cross-sectional view of a fixing bolt portion according to some embodiments of the present disclosure.
Figure 15E:
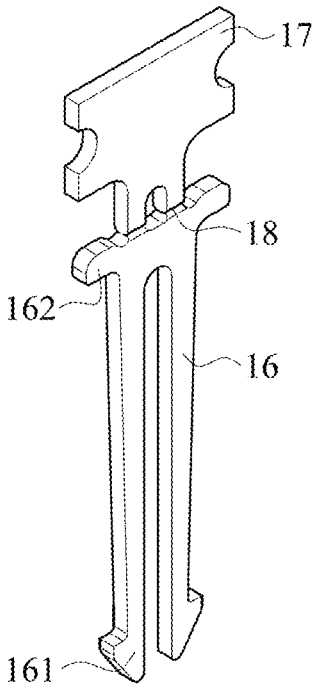
FIG. 15E is a three-dimensional schematic diagram of a fixing bolt according to some embodiments of the present disclosure.

In order to more clearly show a current state of the fixing bolt 16, further refer to FIG. 15C, FIG. 15D, and FIG. 15E. FIG. 15C is a three-dimensional cross-sectional view obtained along a line 15C-15C in FIG. 15B. FIG. 15D is a partial enlarged cross-sectional view of a part of the fixing bolt 16. FIG. 15E is a three-dimensional schematic diagram of the fixing bolt 16.

In some embodiments, as shown in FIG. 15E, a connection neck 18 exists at a joint between the fixing bolt 16 and the fixing bolt assistance component 17. A thickness of the connection neck 18 is less than a thickness of the fixing bolt 16 and the fixing bolt assistance component 17, so that the fixing bolt assistance component 17 can be easily removed therefrom. In some embodiments, two connection necks exist 18 between the fixing bolt assistance component 17 and the fixing bolt 16, but the present disclosure is not limited thereto.

Referring to FIG. 15C and FIG. 15D, in some embodiments, the bolt hole 154 in the supporting plate 152 of the cover component 15 is in communication with the bolt slot 112 in the holding accommodation channel isolation wall 1131 of the insulative housing 11. In some embodiments, a lower end of the fixing bolt 16 has a barb 161, and an upper end may have a portion extending toward two sides to form a blocking component 162 with the fixing bolt 16. The bottom of the bolt slot 112 in the holding accommodation channel isolation wall 1131 may have a bolt slot neck 1121 with a width recessed inward. The width of the bolt slot neck 1121 may be substantially the same as or greater than a width of a middle part of the fixing bolt 16 (in some embodiments, the blocking component 162 to the barb 161 of the fixing bolt 16 is the middle part), and a maximum width of the barb 161 is greater than the width of the bolt slot neck 1121. In this way, the fixing bolt 16 can be prevented from exiting the bolt slot 112. In some embodiments, the barb 161 abuts against a lower part of the bolt slot neck 1121 in the holding accommodation channel isolation wall 1131. Exemplarily, the fixing bolt 16 is made of metal materials, and has better mechanical strength than a fixing bolt 16 made of plastic materials, so that when the fixing bolt 16 is inserted into the insulative housing 11, the barb 161 thereon is less likely to crack.

In some embodiments, a width of the blocking component 162 is greater than the width of the middle part of the fixing bolt 16. In some embodiments, as shown in the cross-sectional view in FIG. 15D, the blocking component 162 is the widest part of the fixing bolt 16. In addition, in some embodiments, an opening part at an upper side (a side away from the insulative housing 11) of the bolt hole 154 of the cover component 15 has a shallow groove 1541 that may be configured to accommodate the blocking component 162, so that cover component 15 has a flat surface. In addition, the blocking component 162 also abuts against the bottom of the shallow groove 1541 to prevent the fixing bolt 16 from continuing entering the bolt hole 154.

In some embodiments, as shown in FIG. 15D, the fixing bolt 16 is in a form of a double fork, that is, the fixing bolt 16 may have an opening (which may be an open or closed opening). The opening may cause the fixing bolt 16 to have a specific elastic deformation capacity, so that the fixing bolt 16 can be more easily inserted into the bolt hole 154 or the bolt slot 112. In some embodiments, the fixing bolt 16 may also be a single fork having a hole (that is, a closed opening).

In some embodiments, as shown in FIG. 15D, when the fixing bolt 16 has an open opening located at the bottom of the fixing bolt 16 (for example, when the fixing bolt 16 is in the form of a double fork), an intermediate blocker 1542 may be formed in the bolt hole 154 of the cover component 15. The intermediate blocker 1542 may be engaged between the two forks of the fixing bolt 16 to further prevent the fixing bolt 16 from continuing entering the bolt hole 154.

In some embodiments, as shown in FIG. 15D, a side wall of the bolt hole 154 is a slope that can effectively guide the fixing bolt 16 to be inserted.

In some embodiments, as shown in FIG. 15D, the bottom of the bolt slot 112 is recessed inward, that is, the bottom of the bolt slot 112 is higher than the bottom of the holding accommodation channel 113. In this way, the lower end of the fixing bolt 16 does not protrude from the insulative housing 11.

Figure 16A:
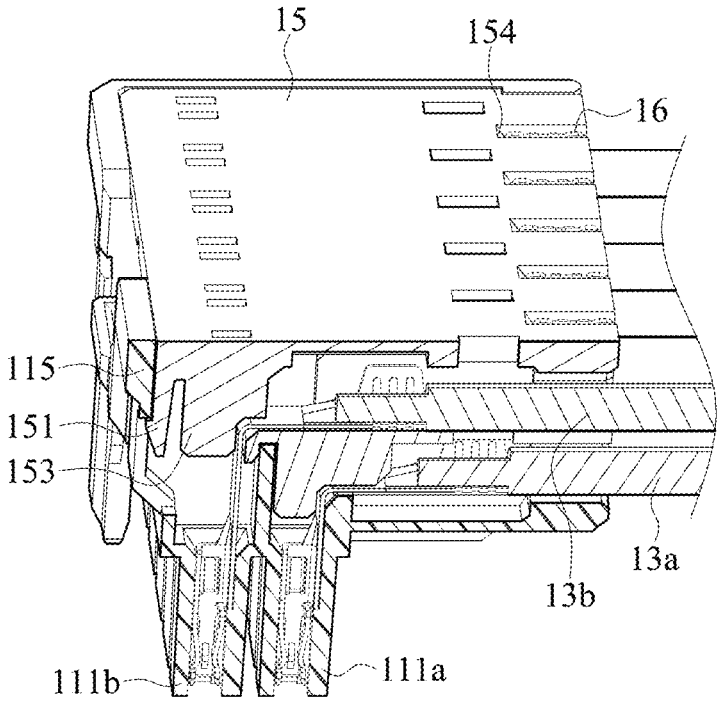
Figure 16B:
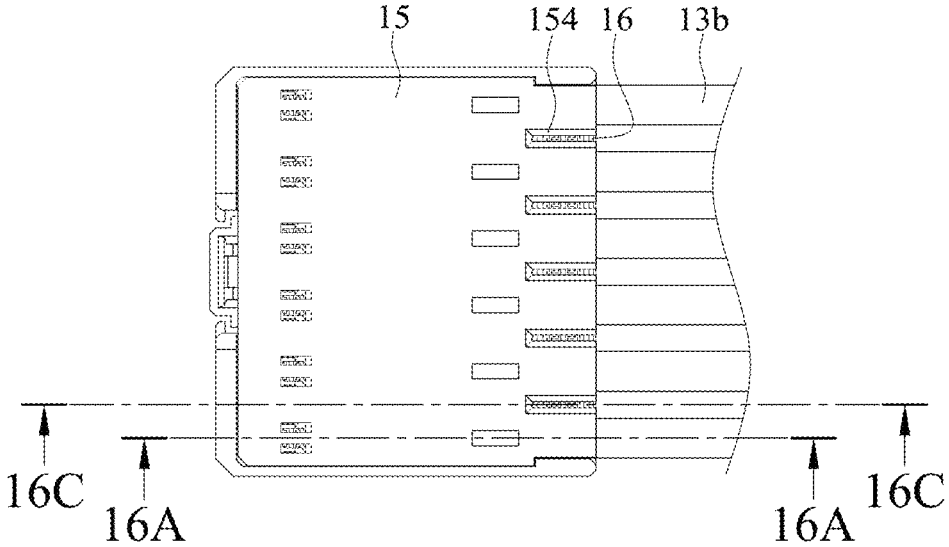
Figure 16C:
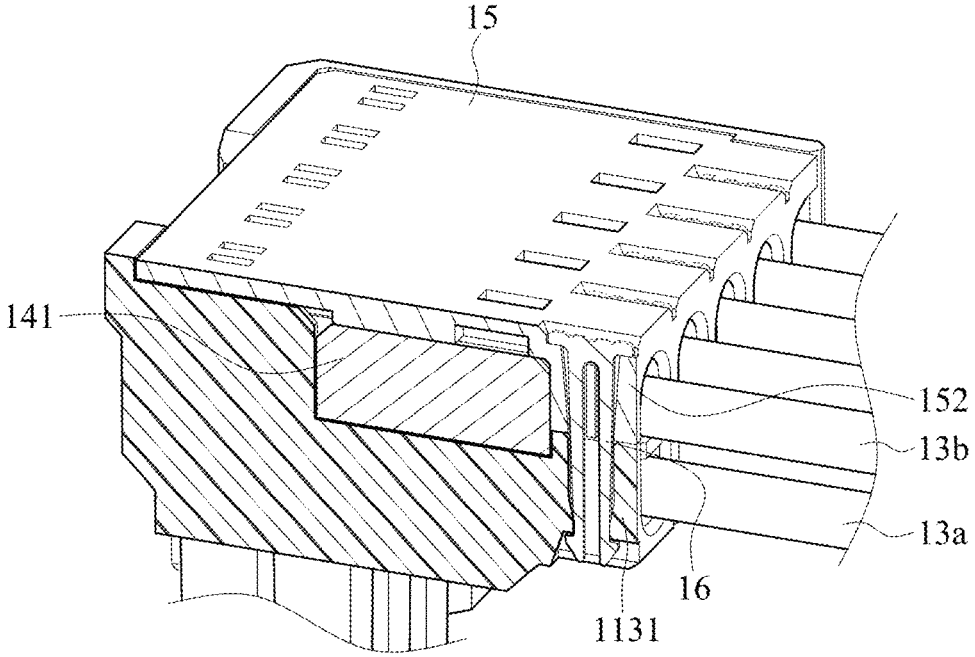
FIG. 16C is a three-dimensional cross-sectional view obtained according to a line 16C-16C in FIG. 16B.

Next, referring to FIG. 16A and FIG. 16B, after the fixing bolt 16 is inserted to engage the cover component 15 and the insulative housing 11, the fixing bolt assistance component 17 may be removed. For a state after removal, further refer to FIG. 16C. FIG. 16C is a three-dimensional cross-sectional view obtained along a line 16C-16C in FIG. 16B.

Figure 17:
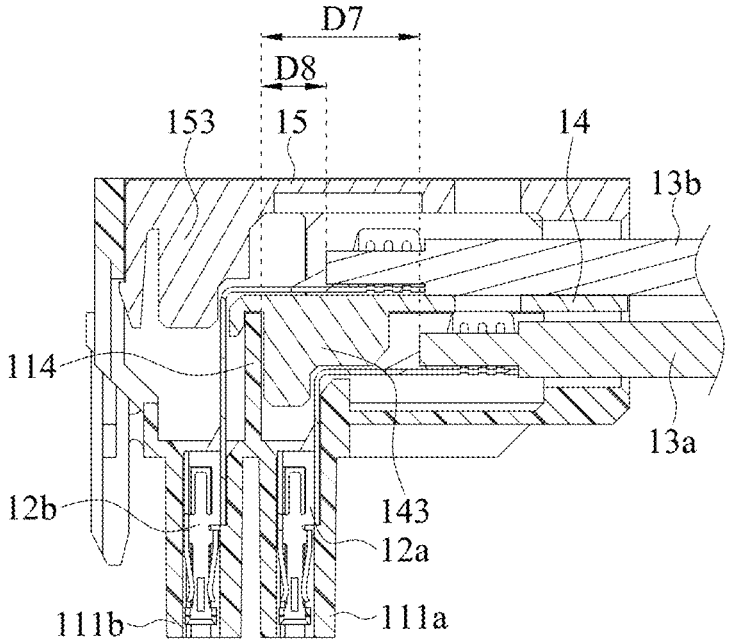
FIG. 17 is a cross-sectional side view of a connector according to some embodiments.

FIG. 17 is a cross-sectional view of the connector 1 along the first wire 13*a* according to some embodiments. In some embodiments, as shown in FIG. 17, a shape of one side of the pressing sheet 143 is substantially the same as the shape of the bent segment of the first female terminal 12*a*. A shape of one side of the cover component pressing sheet 153 is substantially the same as a shape of the bent segment of the second female terminal 12*b*. Distances between wires 13 at different layers and the holding accommodation channel row isolation wall 114 are different. Distances between holding segments of female terminals 12 at different layers and the holding accommodation channel row isolation wall 114 are different.

In some embodiments, the mating segment of the first female terminal 12*a* and/or the second female terminal 12*b* used in the connector 1 for mating with the male terminal may use the above mating segment structure in the present disclosure. In some embodiments, the mating segment of the first female terminal 12*a* and/or the second female terminal 12*b* used in the connector 1 may have the structures shown in FIG. 4A and FIG. 4B, and details are not repeated herein.

In some embodiments, during use of the female terminal having the mating segment structures in the present disclosure, the mating accommodation channels 111*a* and 111*b* of the insulative housing 11 may have corresponding structures.

Figure 18A:
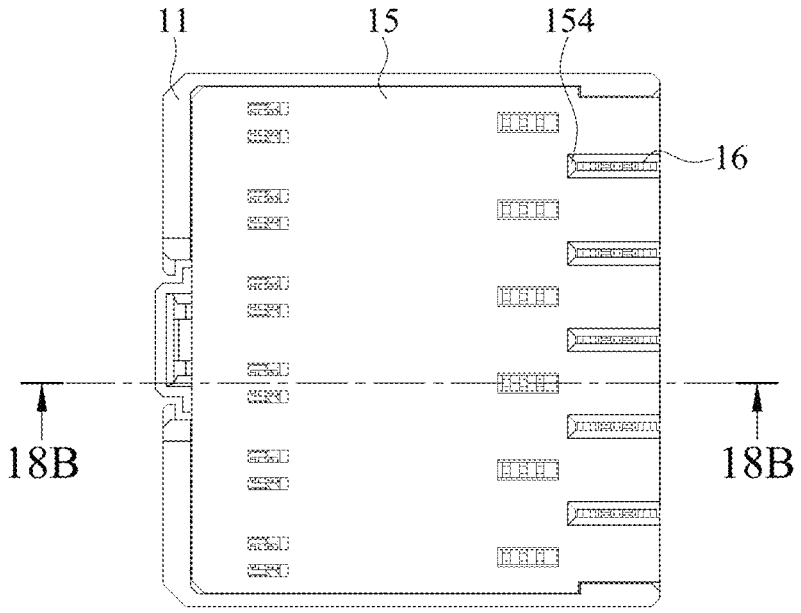
FIG. 18A is a top view of a connector in FIG. 16B omitting a wire.
Figure 18B:
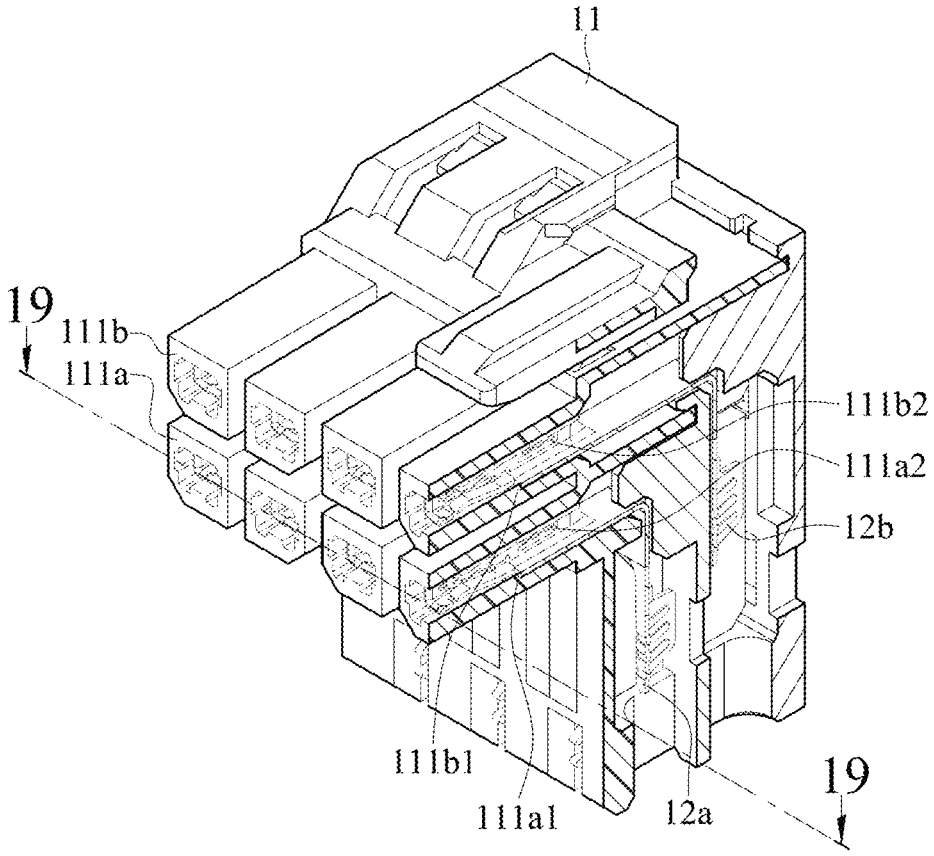
FIG. 18B is a three-dimensional cross-sectional view of a connector along a line 18B-18B in FIG. 18A according to some embodiments.
Figure 19:
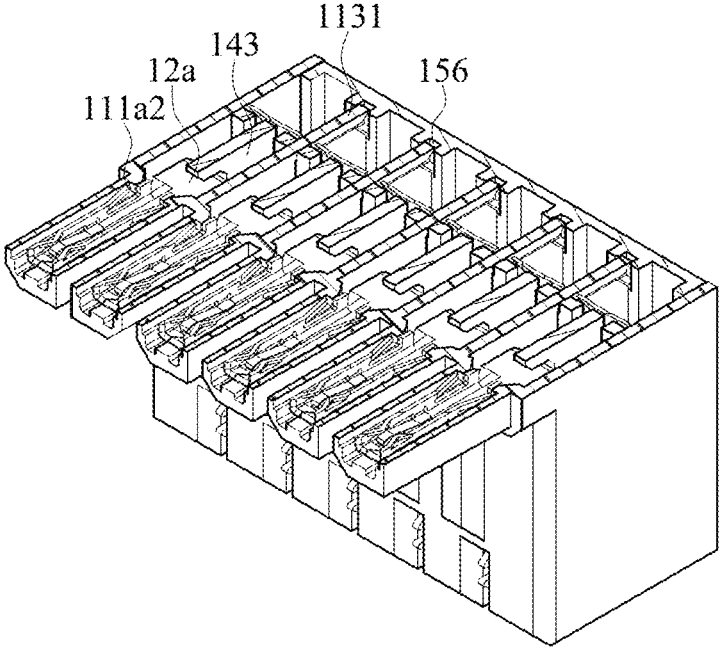
FIG. 19 is a three-dimensional cross-sectional view of a connector along a line 19-19 in FIG. 18B according to some embodiments.

Referring to FIG. 18A, FIG. 18B, and FIG. 19, FIG. 18A is a top view of the connector 1 in FIG. 16B omitting a wire; FIG. 18B is a three-dimensional cross-sectional view of the connector 1 along a line 18B-18B in FIG. 18A according to some embodiments (a wire is omitted, and the connector 1 is turned by 90 degrees for ease of observation); and FIG. 19 is a three-dimensional cross-sectional view along a line 19-19 in FIG. 18B.

In some embodiments, as shown in FIG. 18B and FIG. 19, an inner wall of the first mating accommodation channel 111*a* and/or the second mating accommodation channel 111*b* may have blockers 111*a*1 and 111*b*1, so that a lower side wall 413 (for a position, referring to FIG. 4B) connected to the base part 41 of the mating segment abuts against the blockers 111*a*1 and 111*b*1 to prevent the mating segment from moving forward. In some embodiments, the inner wall of the first mating accommodation channel 111*a* and/or the second mating accommodation channel 111*b* has backstop grooves 111*a*2 and 111*b*2. A backstop arm 414 of the base wall 411 of the base part of the mating segment protruding toward outside of the passage abuts against walls of the backstop grooves 111*a*2 and 111*b*2 to prevent the mating segment from moving backward. In addition, it may be clearly learned from FIG. 19 that, in some embodiments, since a shape of one side of the pressing sheet 143 of the isolation wall 14 protruding toward the first female terminal 12*a* matches the shape of the bent segment of the first female terminal 12*a*, the position of the first female terminal 12*a* can be further fixed.

In some embodiments, as shown in FIG. 19 and FIG. 26B below, the cover component 15 may have a cover component groove 156 that may be configured to accommodate the holding accommodation channel isolation wall 1131.

Figure 20:
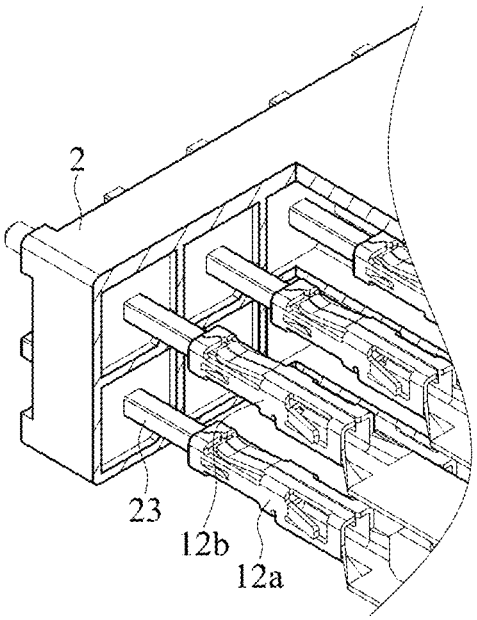
FIG. 20 is a three-dimensional schematic diagram of usage of a connector omitting an insulative housing and a part of an outer wall of a socket according to some embodiments.
Figure 21:
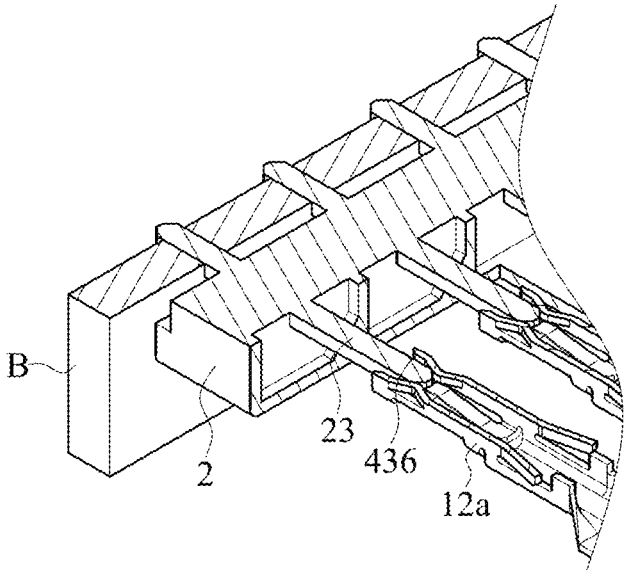
FIG. 21 is a three-dimensional diagram of a transverse section of terminal engagement in FIG. 20.
Figure 22:
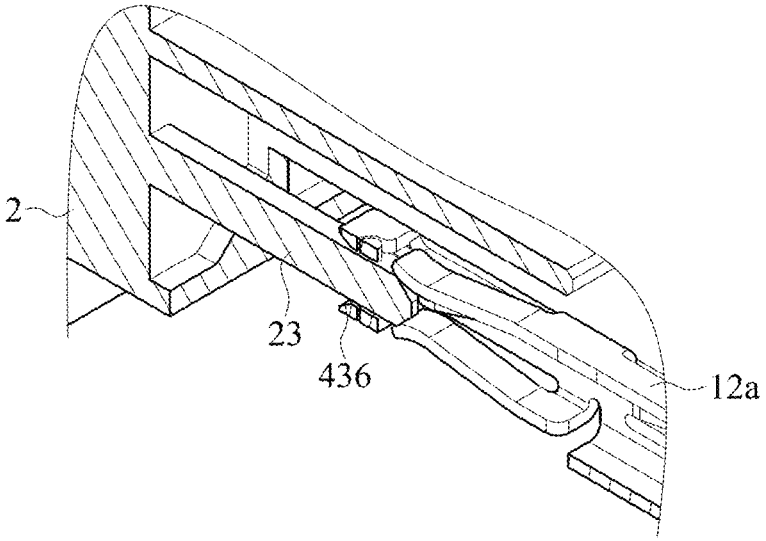
FIG. 22 is a three-dimensional diagram of a longitudinal section of terminal engagement in FIG. 20.

In some embodiments, for mating between the connector 1 and the male terminal in the socket 2, refer to FIG. 20, FIG. 21, and FIG. 22. FIG. 20 is a three-dimensional schematic diagram of usage of a connector omitting the insulative housing 11 and a part of an outer wall of the socket 2. FIG. 21 and FIG. 22 are three-dimensional diagrams of a transverse section and a longitudinal section of terminal engagement, respectively.

As shown in FIG. 21 and FIG. 22, in some embodiments, the guide slope 436 at an outer side of the mating segment (or the port part) of the female terminal 12 may assist in inserting the male terminal 23 into the female terminal 12. An end of the male terminal 23 for mating with the female terminal 12 may also have a guide slope to facilitate mating.

FIG. 23 is a three-dimensional schematic diagram of the connector 1 according to some embodiments (the wire 13 is omitted). In the embodiment shown in FIG. 23, it may be learned that the supporting plate 152 of the cover component 15 and the holding accommodation channel isolation wall 1131 together form a space for accommodating the wire 13, and the isolation plate 14 may be configured to isolate female terminals 12 and wires 13 at different layers.

Figure 24:
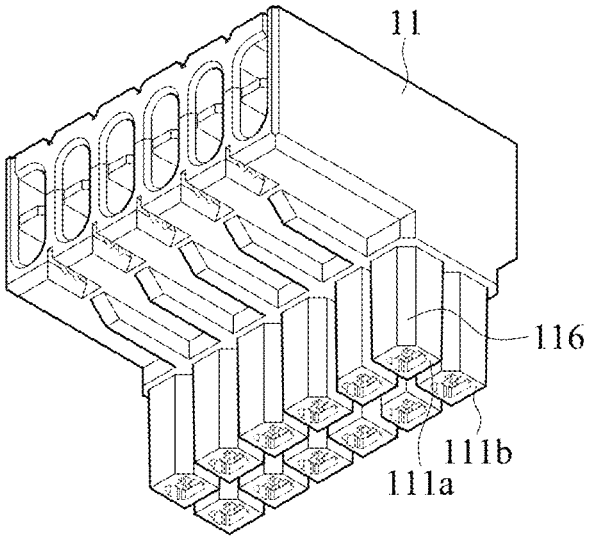
FIG. 24 is a three-dimensional diagram of the connector in FIG. 23 from another perspective.

FIG. 24 is a three-dimensional diagram of the connector 1 in FIG. 23 from another perspective. As shown in FIG. 24, in some embodiments, the first mating accommodation channel 111*a* or the second mating accommodation channel 111*b* may have an anti-misinsertion feature 116, and the slot 21 of the socket 2 has a corresponding shape corresponding to the connected mating accommodation channels 111*a* and 111*b*. The first mating accommodation channel 111*a* or the second mating accommodation channel 111*b* is allowed to be connected to the slot 21 of the socket 2 only in a correct mating direction.

In summary, the present disclosure provides a female terminal with a bent segment. In this way, an angle exists between an axial direction of a male terminal to be subsequently inserted and an axial direction of a wire in contact with the female terminal, so that more types of wiring requirements and designs can be met. In addition, the present disclosure further provides a connector using the above female terminal and a multipoint contact structure applied to the mating segment of the female terminal.

Although the present disclosure has been described in considerable detail with reference to certain preferred embodiments thereof, the disclosure is not for limiting the scope of the disclosure. Persons having ordinary skill in the art may make various modifications and changes without departing from the scope and spirit of the disclosure. Therefore, the scope of the appended claims should not be limited to the description of the preferred embodiments described above.

What is claimed is:

1. A connector, comprising:

a female terminal comprising:

a mating segment having a mating axial direction;

a holding segment having an accommodation channel, a wire being disposed in the accommodation channel, and the accommodation channel having an accommodation-channel axial direction; and a bent segment connected to the mating segment and the holding segment, the mating axial direction being substantially not parallel to the accommodation-channel axial direction;

an insulative housing comprising a mating accommodation channel and a holding accommodation channel in communication with each other, the mating segment of the female terminal being disposed in the mating accommodation channel, and the holding segment and the wire being disposed in the holding accommodation channel; and a cover component covered on the insulative housing and having a buckling convex portion abutting against a buckling shoulder on the insulative housing;

wherein the connector further comprises:

a plurality of mating accommodation channels arranged into a first mating accommodation channel row, the mating accommodation channel in the first mating accommodation channel row being a first mating accommodation channel;

a plurality of holding accommodation channels, a number of the plurality of holding accommodation channels corresponding to a number of the mating accommodation channels in the first mating accommodation channels row; and a second mating accommodation channel row consisting of a plurality of second mating accommodation channels, disposed side by side with the first mating accommodation channel row, and being farther from the holding accommodation channel than the first mating accommodation channel row, wherein a holding accommodation channel isolation wall exists between the plurality of holding accommodation channels, and the cover component has a supporting plate protruding toward the mating segment, the supporting plate abutting against the holding accommodation channel isolation wall;

the female terminal disposed in the first mating accommodation channel row is a first female terminal, the wire connected to the first female terminal is a first wire; the connector further comprises an isolation plate disposed above the first wire and located between the cover component and the insulative housing, the holding accommodation channel isolation wall has a groove, and the isolation plate is disposed in the groove; and wherein an isolation sheet exists above the isolation plate, the isolation sheet being disposed corresponding to the holding accommodation channel isolation wall.

2. The connector according to claim 1, wherein the isolation plate has at least one embedding slit, at least one holding accommodation channel isolation wall being embedded in the embedding slit.

3. The connector according to claim 1, wherein a mating accommodation channel row isolation wall exists between the first mating accommodation channel row and the second mating accommodation channel row.

4. The connector according to claim 1, wherein an inner wall of the mating accommodation channel has a blocker, a part of the mating segment abutting against the blocker to prevent the mating segment from moving forward, and the inner wall of the mating accommodation channel further has a backstop groove, and the mating segment has a backstop arm protruding toward outside of a passage, the backstop arm abutting against the backstop groove to prevent the mating segment from moving backward.

5. The connector according to claim 1, wherein the cover component has a bolt hole, the holding accommodation channel isolation wall having a bolt slot corresponding to the bolt hole of the cover component; and the connector further comprises a fixing bolt inserted from the bolt hole of the cover component into the bolt slot, wherein the fixing bolt has an opening, and one end of the fixing bolt close to the insulative housing has a barb, and the bolt slot has a bolt slot neck, the barb abutting against a lower part of the bolt slot neck.

6. The connector according to claim 3, wherein a pressing sheet protrudes from the isolation plate toward the bent segment, the pressing sheet being disposed at a position at which the first mating accommodation channel is in communication with the holding accommodation channel; and a tail end of the isolation plate has an end wall extending toward the mating segment, a holding space being formed between the end wall and the pressing sheet, the holding space accommodating the mating accommodation channel row isolation wall.

7. The connector according to claim 6, wherein a shape of one side of the pressing sheet matches a bending shape of a bent segment of the first female terminal.

8. The connector according to claim 5, wherein a shallow groove is formed at an opening part above the bolt hole of the cover component, and a blocking component exists at an upper part of the fixing bolt, the blocking component being accommodated in the shallow groove.

9. The connector according to claim 5, wherein a fixing bolt assistance component is further disposed above the fixing bolt, the fixing bolt assistance component being removable from the fixing bolt.

10. A connector, comprising:

a female terminal comprising:

a mating segment having a mating axial direction;

a holding segment having an accommodation channel, a wire being disposed in the accommodation channel, and the accommodation channel having an accommodation-channel axial direction; and a bent segment connected to the mating segment and the holding segment, the mating axial direction being substantially not parallel to the accommodation-channel axial direction;

an insulative housing comprising a mating accommodation channel and a holding accommodation channel in communication with each other, the mating segment of the female terminal being disposed in the mating accommodation channel, and the holding segment and the wire being disposed in the holding accommodation channel; and a cover component covered on the insulative housing and having a buckling convex portion abutting against a buckling shoulder on the insulative housing;

wherein the connector further comprises:

a plurality of mating accommodation channels arranged into a first mating accommodation channel row, the mating accommodation channel in the first mating accommodation channel row being a first mating accommodation channel;

a plurality of holding accommodation channels, a number of the plurality of holding accommodation channels corresponding to a number of the mating accommodation channels in the first mating accommodation channels row; and a second mating accommodation channel row consisting of a plurality of second mating accommodation channels, disposed side by side with the first mating accommodation channel row, and being farther from the holding accommodation channel than the first mating accommodation channel row, wherein a holding accommodation channel isolation wall exists between the plurality of holding accommodation channels, and the cover component has a supporting plate protruding toward the mating segment, the supporting plate abutting against the holding accommodation channel isolation wall;

the female terminal disposed in the first mating accommodation channel row is a first female terminal, the wire connected to the first female terminal is a first wire; the connector further comprises an isolation plate disposed above the first wire and located between the cover component and the insulative housing, the holding accommodation channel isolation wall has a groove, and the isolation plate is disposed in the groove; and the connector further comprises another female terminal disposed in the second mating accommodation channel row defined as a second female terminal, another wire connected to the second female terminal defined as a second wire, and the second female terminal and the second wire are disposed above the isolation plate.

11. The connector according to claim 10, wherein an accommodation-channel axial direction of the first female terminal is parallel to an accommodation-channel axial direction of the second female terminal.

12. The connector according to claim 10, wherein the cover component further comprises a cover component pressing sheet protruding downward and disposed corresponding to the second female terminal, a shape of one side of the cover component pressing sheet matching a bending shape of a bent segment of the second female terminal.

13. The connector according to claim 10, wherein a length of a bent segment of the second female terminal is greater than a length of a bent segment of the first female terminal.

14. A connector, comprising:

a female terminal comprising:

a mating segment having a mating axial direction;

a holding segment having an accommodation channel, a wire being disposed in the accommodation channel, and the accommodation channel having an accommodation-channel axial direction; and a bent segment connected to the mating segment and the holding segment, the mating axial direction being substantially not parallel to the accommodation-channel axial direction;

an insulative housing comprising a mating accommodation channel and a holding accommodation channel in communication with each other, the mating segment of the female terminal being disposed in the mating accommodation channel, and the holding segment and the wire being disposed in the holding accommodation channel;

a cover component covered on the insulative housing and having a bolt hole; and a fixing bolt inserted from the bolt hole of the cover component into the insulative housing.

15. The connector according to claim 14, wherein the fixing bolt has an opening, and one end of the fixing bolt close to the insulative housing has a barb.

16. The connector according to claim 15, wherein the fixing bolt is made of metal.

17. The connector according to claim 15, wherein the insulative housing comprises a plurality of holding accommodation channels, a holding accommodation channel isolation wall existing between the plurality of holding accommodation channels, the holding accommodation channel isolation wall having a bolt slot corresponding to the bolt hole of the cover component, the bolt slot having a bolt slot neck, the barb abutting against a lower part of the bolt slot neck.

* * * * *